US007186058B2

(12) United States Patent
Schluter et al.

(10) Patent No.: US 7,186,058 B2
(45) Date of Patent: Mar. 6, 2007

(54) STORMWATER DETENTION SYSTEM AND METHOD

(75) Inventors: James C. Schluter, Franklin, OH (US); Vaikko P. Allen, II., Portland, ME (US); Daniel P. Cobb, Portland, ME (US); Thomas R. Adams, Chebeague Island, ME (US)

(73) Assignee: Contech Stormwater Solutions Inc., Scarborough, ME (US)

( * ) Notice: Subject to any disclaimer, the term of this patent is extended or adjusted under 35 U.S.C. 154(b) by 47 days.

(21) Appl. No.: 11/036,772

(22) Filed: Jan. 14, 2005

(65) Prior Publication Data

US 2006/0159519 A1 Jul. 20, 2006

(51) Int. Cl.
*E02B 1/00* (2006.01)
*E02B 3/00* (2006.01)
*E02B 11/00* (2006.01)

(52) U.S. Cl. ..... 405/80; 405/39; 210/170

(58) Field of Classification Search ..... 405/36, 405/39–41, 51, 52, 80; 210/170, 747
See application file for complete search history.

(56) References Cited

U.S. PATENT DOCUMENTS

| | | | | | |
|---|---|---|---|---|---|
| 4,275,766 | A * | 6/1981 | Aronson | 138/37 |
| 4,298,470 | A * | 11/1981 | Stallings | 405/39 |
| 4,303,350 | A * | 12/1981 | Dix | 405/36 |
| 5,249,887 | A * | 10/1993 | Phillips | 405/36 |
| 5,322,387 | A | 6/1994 | Heine et al. | 405/36 |
| 5,342,144 | A | 8/1994 | McCarthy | 405/39 |
| 6,062,767 | A | 5/2000 | Kizhnerman et al. | 405/39 |
| 6,371,690 | B1 | 4/2002 | Monteith | 405/39 |
| 6,405,974 | B1 | 6/2002 | Herrington | 242/609.4 |
| 6,547,962 | B2 | 4/2003 | Kistner et al. | 210/170 |
| 6,638,424 | B2 | 10/2003 | Stever et al. | 210/170 |
| 6,796,325 | B1 | 9/2004 | Courier | 137/357 |
| 7,052,206 | B1 | 5/2006 | Mastromonaco | 404/39 |
| 2002/0139736 | A1 | 10/2002 | Stever et al. | 210/170 |
| 2004/0069715 | A1 | 4/2004 | Stever et al. | 210/747 |
| 2004/0074846 | A1 | 4/2004 | Stever et al. | 210/747 |
| 2005/0036840 | A1 | 2/2005 | Fleeger | 405/96 |

OTHER PUBLICATIONS

Split Flow Method: Introduction of a New Stormwater Strategy, by Stuart Patton Echols, *Stormwater*, Jul./Aug. 2002, pp. 16-32.

(Continued)

*Primary Examiner*—Thomas B. Will
*Assistant Examiner*—Tara L. Mayo
(74) *Attorney, Agent, or Firm*—Thompson Hine LLP

(57) ABSTRACT

A stormwater runoff detention system includes a system including an inlet, a first surge chamber, a second surge chamber and one or more storage chambers. The first surge chamber is connected to receive stormwater from the inlet prior to the second surge chamber or the storage chamber. The first surge chamber includes a discharge outlet and an overflow outlet to the storage chamber. The second surge chamber is connected to receive stormwater from the inlet primarily after the first surge chamber has begun overflowing to the storage chamber. The second surge chamber includes a discharge outlet and an overflow outlet to the storage chamber or to a second storage chamber.

50 Claims, 24 Drawing Sheets

OTHER PUBLICATIONS

The Extention Basin 20, The Most Efficient Method for Treatment of Stormwater Peak Flows and Runoff Pollutants, A Service of Extention Basin Systems, Inc., 13 Dove Court, Croton-on-Hudson, NY 10520; http://www.extensionbasin.com/index.htm; publication date unknown, 2 pages.

The Extention Basin as a Storm Water Control Device, By Ralph G. Mastromonaco, P.E., President, consulting Engineers, Croton-on-Hudson, NY 10520; Publication date listed as Aug. 31, 2000, http://www.extensionbasin.com/THEORY.HTM.

* cited by examiner

STORMWATER DETENTION SYSTEM AND METHOD

TECHNICAL FIELD

The present application relates generally to detention systems for use in controlling stormwater runoff.

BACKGROUND

Stormwater detention systems are used to control water runoff resulting from rainfall. Such detention systems can help reduce occurrences of, for example, downstream flooding, soil erosion and water quality degradation by collecting the rainfall and controllably discharging the collected water from the detention system.

Often times, communities require that land developments include some form of stormwater control system that limits the discharge of stormwater to a certain rate or rates. These required rates may correspond to the rates of stormwater runoff before the property was developed. The allowable rate in a particular community may change depending on the type of storm. For example, some communities may allow higher stormwater discharge rates during more severe storms that include relatively large amounts of rainfall and require lower stormwater discharge rates during less severe storms that include relatively small amounts of rainfall.

Commonly used detention systems provide a large storage volume (e.g., a buried tank or a detention pond) that begins to fill as soon as stormwater runoff begins. The large storage volume has an outlet that is sized to provide a certain output flow rate when the head in the storage volume reaches its maximum. However, when the level of water in the storage volume is low, the output flow rate can in many cases be less than that which is permitted by applicable codes, regulations, etc. It would be desirable to provide a detention system that begins to output stormwater at the permitted rate relatively quickly and/or that does not begin to fill the storage volume until the water inflow rate exceeds the permitted outflow rate.

SUMMARY

In an aspect, a stormwater runoff detention system includes a system including an inlet, a first surge chamber, a second surge chamber and a storage chamber. The first surge chamber is connected to receive stormwater from the inlet prior to the second surge chamber or the storage chamber. The first surge chamber includes a discharge outlet and an overflow outlet to the storage chamber. The second surge chamber is connected to receive stormwater from the inlet primarily after the first surge chamber has begun overflowing to the storage chamber. The second surge chamber includes a discharge outlet and an overflow outlet to the storage chamber. In other embodiments multiple storage chambers may be provided, or a single surge chamber may include multiple overflow outlets to one or more storage chambers.

In another aspect, a detention system is configured to automatically adjust its discharge rate (e.g., to a maximum allowable rate based on regulatory requirements) depending on a storm's return period.

The use of the systems described herein may enable detention systems to be designed with a smaller overall footprint or volume by optimizing outflow from the detention systems in accordance with a number of specific storm events and local regulations.

The details of one or more embodiments are set forth in the accompanying drawings and the description below. Other features, objects, and advantages will be apparent from the description and drawings, and from the claims.

DETAILED DESCRIPTION

Referring to FIGS. 1–23, stormwater detention systems are diagrammatically depicted that can rapidly attain and maintain, for a period of time, a desired flow rate or series of differing, desired flow rates using primarily (or exclusively) non-mechanical (i.e., non-moving) components. The stormwater detention systems can automatically adjust the discharge rate of stormwater from the discharge system to the receiving environment depending on the intensity and/or accumulated flow volume of a particular storm event. Storm events may be categorized by their probability of occurrence, often referred to as "return period". The return period is the average number of years between two rainfall events which equal or exceed a given number of inches over a given duration. As an example, a rainfall of five inches in 24 hours in western Texas has a return period of ten years and might represent a first storm event whereas a rainfall of five inches in 12 hours in the same region has a return period of 25 years and might represent a second storm event.

Figure 1:
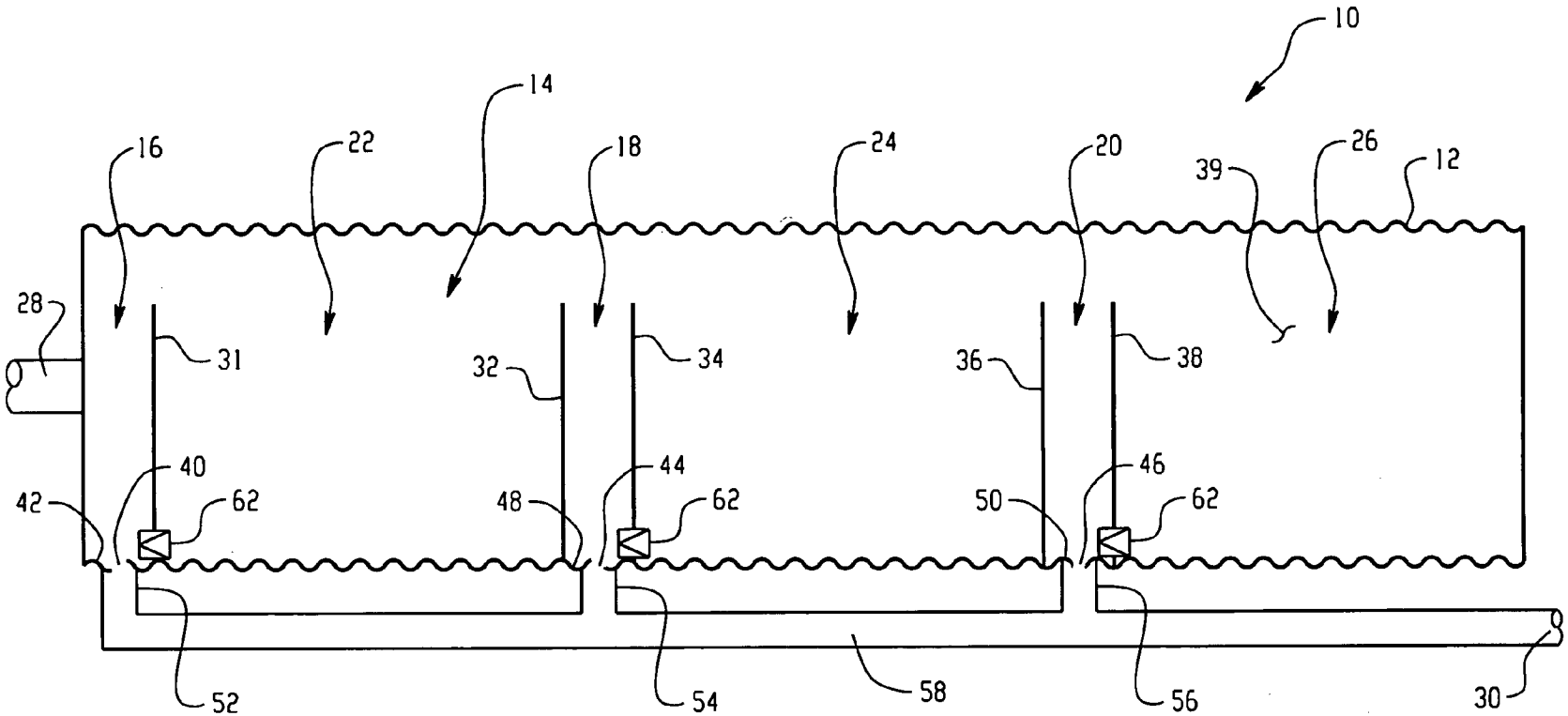
FIG. 1 is a diagrammatic, section illustration of an embodiment of a stormwater detention system.

Referring to FIG. 1, stormwater detention system 10 is capable of accommodating multiple storm events of differing return periods by providing multiple surge chambers 16, 18 and 20 designed to rapidly increase hydraulic head in the surge chamber and to discharge the stormwater therefrom. The detention system 10 includes a tank 12 having a primary inlet 28 for ingress of stormwater to an internal volume 14 of the tank and a primary outlet 30 for egress of stormwater from the internal volume of the tank. Internal volume 14 is divided into multiple surge chambers 16, 18 and 20 and multiple storage chambers 22, 24 and 26 by spaced-apart weirs 31, 32, 34, 36 and 38 connected to an inner surface 39 of the tank 12. While the weirs are shown having similar heights, they can have differing heights. Tank 12 may be of any suitable construction such as metal, plastic or concrete.

The weirs 31, 32, 34, 36, 38 are arranged such that the surge chambers 16, 18 and 20 have substantially less detention volume than those of the storage chambers 22, 24 and 26. The relatively low volumes allow the surge chambers 16, 18 and 20 to fill and generate hydraulic head relatively quickly within the respective volumes, e.g., to increase stormwater discharge through respective discharge outlets 40, 44, 46 having fixed dimension openings. For simplicity, as used herein, a surge chamber refers to a chamber having a relatively low volume for generating hydraulic head at a rate significantly faster than that of a storage chamber that communicates with the surge chamber.

First surge chamber 16 is in direct communication with primary inlet 28 and includes discharge outlet 40 having a fixed dimension opening located at its base 42. Similarly, second and third surge chambers 18 and 20 each include respective discharge outlets 44 and 46 having fixed dimension openings located at their bases 48 and 50. The discharge outlets 40, 44 and 46 are connected to fluid passageways 52, 54 and 56, which, in the illustrated embodiment, form converging fluid paths within a discharge conduit 58 leading to the primary outlet 30, each path bypassing one or more of the storage chambers 22, 24, 26. Alternatively, the fluid conduits 52, 54 and 56 may not converge into the same conduit, in which case each may provide a separate discharge outlet from the detention system 10. The discharge outlets 40, 44, 46 can have a diameter that is less than that of the passageways 52, 54, 56 and discharge conduit 58.

Each storage chamber 22, 24, 26 receives overflow from a respective surge chamber 16, 18, 20. A one-way valve 62 (e.g., a gate valve or platypus valve) allows fluid communication from the storage chambers 22, 24, 26 to the respective surge chambers 16, 18, 20 when pressure on the surge chamber side of the valve is less than the pressure on the storage chamber side of the valve. This arrangement can allow stormwater detained in the storage chambers to discharge through the surge chambers, e.g., once the storm has decreased in intensity.

Figure 2:
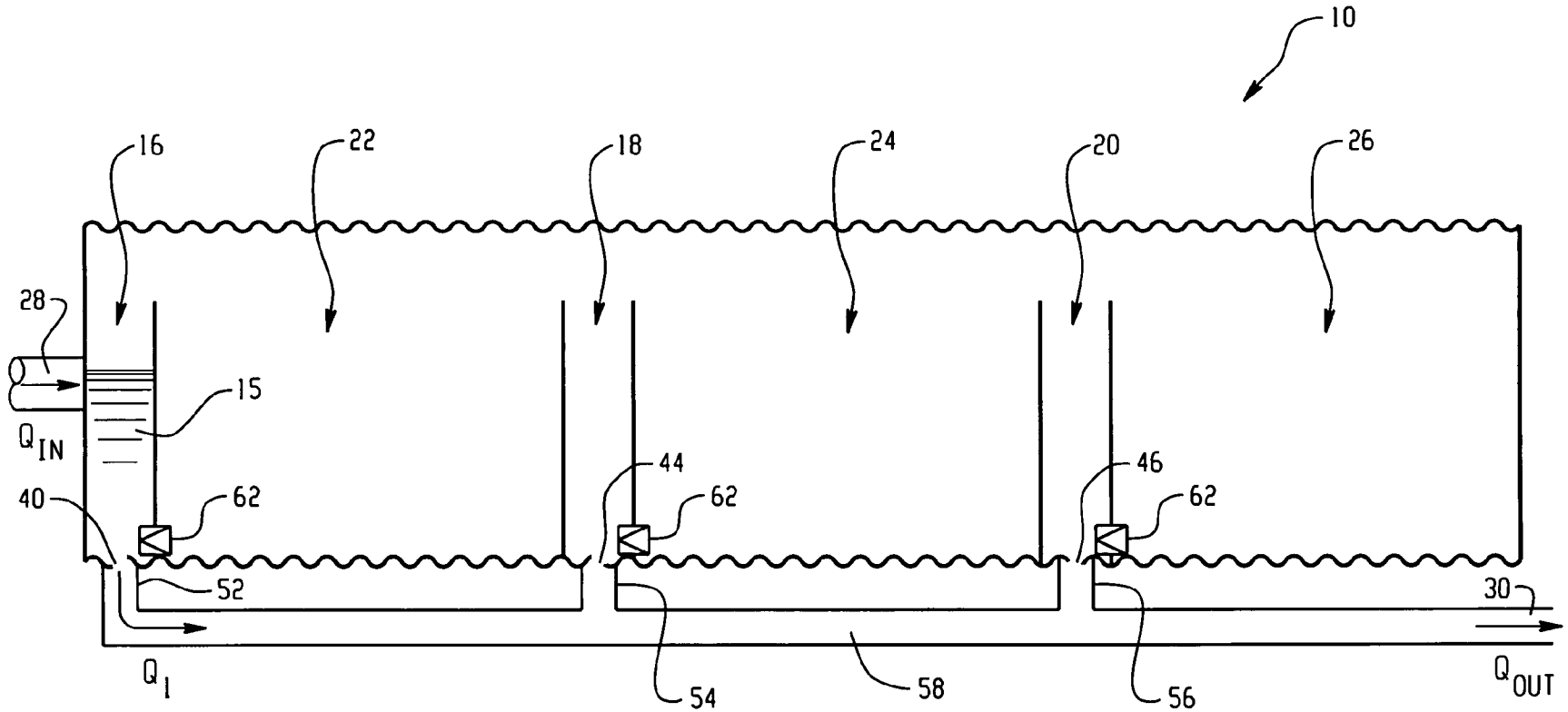
FIGS. 2–4 are section illustrations of the stormwater detention system of FIG. 1 in use.
Figure 3:
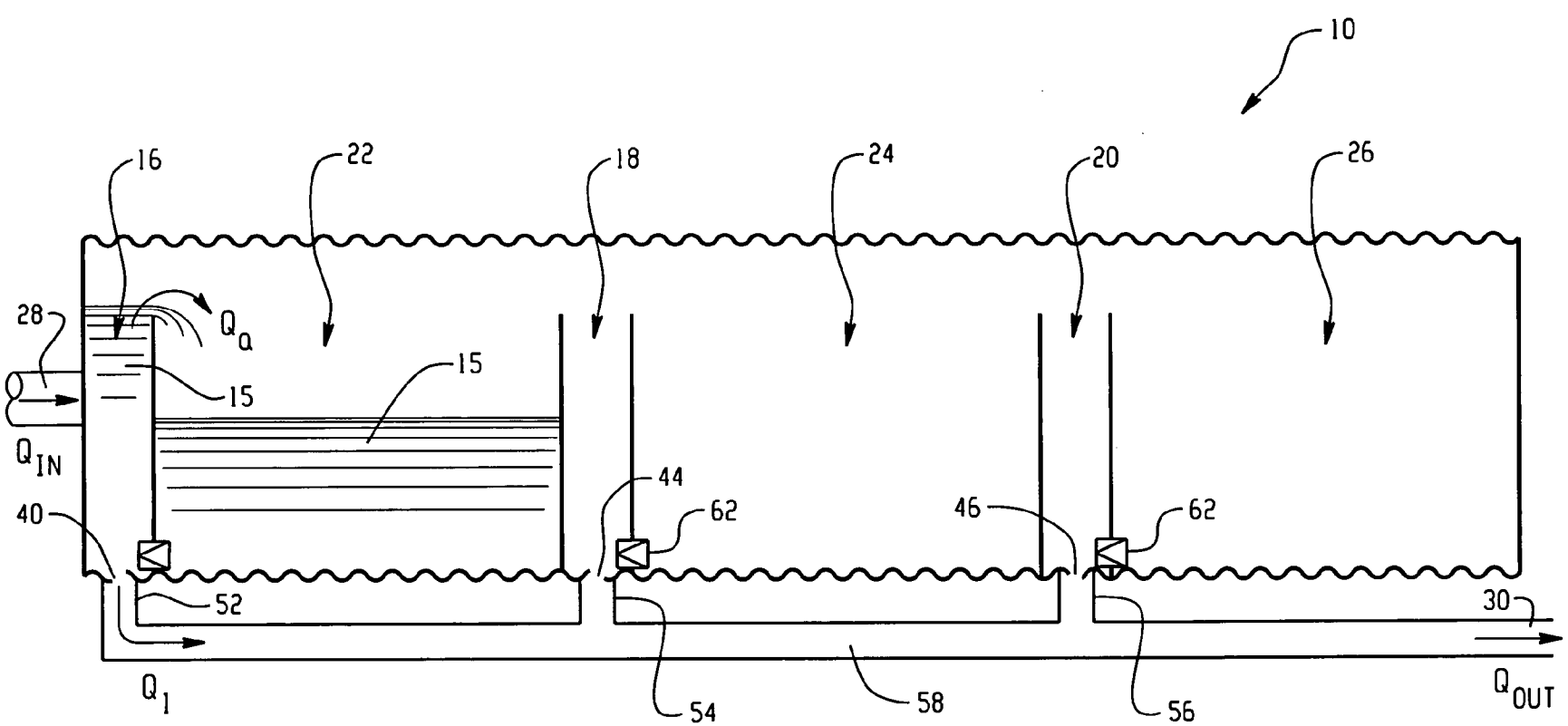
Figure 4:
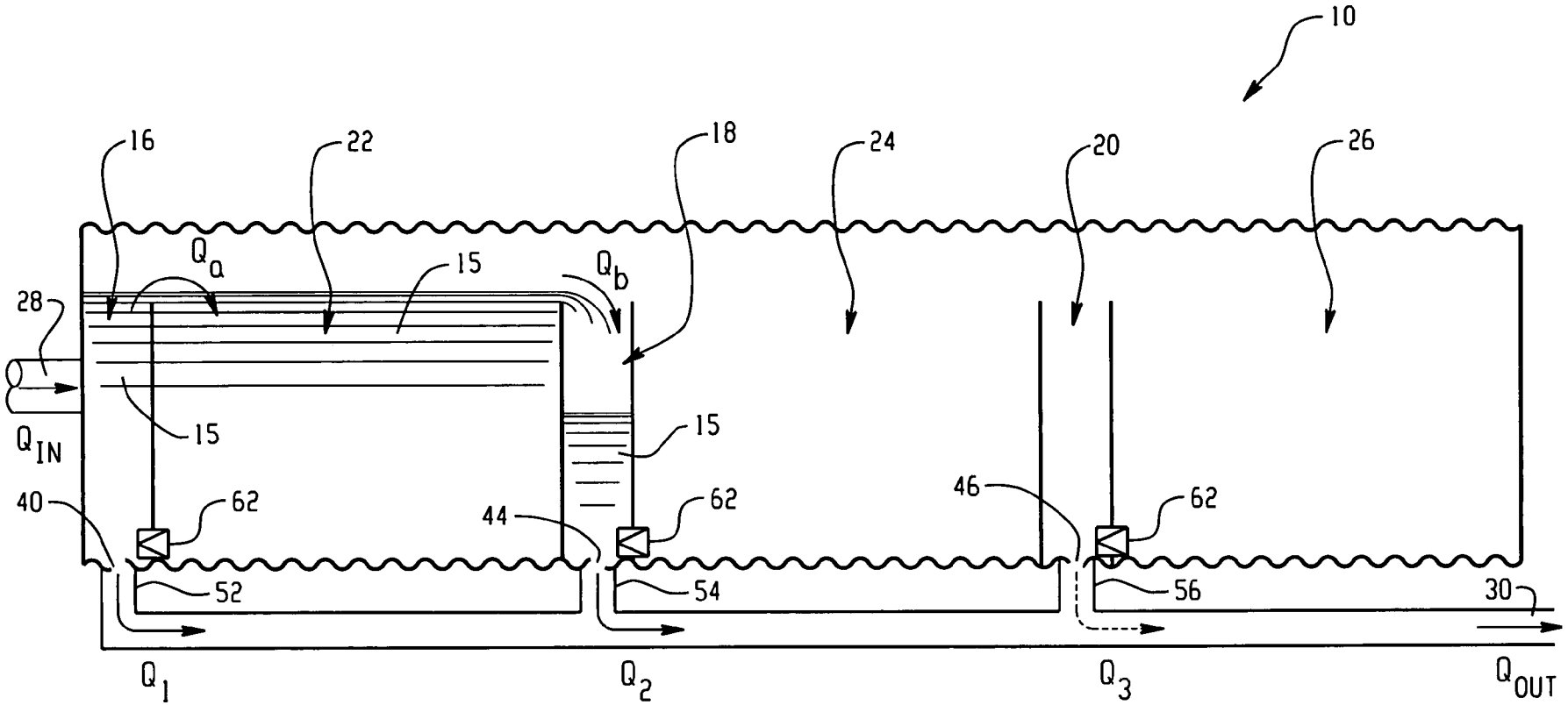

FIGS. 2–4 show the detention system 10 during use. Referring to FIG. 2, as stormwater flows from the primary inlet 28 into the first surge chamber 16 at a flow rate $Q_{in}$, stormwater 15 is discharged from the surge chamber 16 through the outlet 40 at a flow rate $Q_1$ (that increases as the head in surge chamber 16 increases), bypassing the first storage chamber 22. At relatively low stormwater in flow rates (e.g., from storm events having relatively frequent return periods), most, if not all, of the stormwater received in surge chamber 16 is discharged directly through the outlet 40, bypassing the storage chambers 22, 24, 26. The outlet 40 is sized such that the surge chamber 16 fills at higher inflow rates, increasing both the hydraulic head and the discharge rate through the outlet 40.

Referring to FIG. 3, more intense storms (e.g., storm events having relatively less frequent return periods) result in stormwater overflow from the surge chamber 16 at a rate $Q_a$ (where, as shown, $Q_a=Q_{in}-Q_1$) into the storage chamber 22 while stormwater continues to discharge from surge chamber 16 through outlet 40 at its maximum discharge rate. Because the storage chamber 22 has a much larger detention volume than that of the surge chamber 16, in most cases, it takes much longer for the storage chamber 22 to fill and generate hydraulic head compared to the surge chamber 16. The storage chamber 22 can fill until, referring to FIG. 4, stormwater overflows into second surge chamber 18.

Similar to the surge chamber 16, as surge chamber 18 fills, stormwater is discharged from the second surge chamber 18 through discharge outlet 44 at a flow rate $Q_2$ (that increases as the head in surge chamber 18 increases), automatically increasing the total flow rate $Q_{out}$ from the detention system. The above process can repeat for the second storage chamber 24, the third surge chamber 20 and third storage chamber 26, e.g., automatically increasing $Q_{out}$ by adding $Q_3$ (shown by dotted lines) from the third surge chamber 20.

In one embodiment, each surge storage chamber is designed to accommodate a storm event of specified return period. For example, the first storage chamber 22 may be sized to allow the detention system 10 to accommodate a storm event having a 2-year or 4-year return period, the second storage chamber 24 may be sized to allow the detention system 10 to accommodate a storm event having a ten-year or 25-year return period and the third storage chamber 26 may be sized to allow the detention system 10 to accommodate a storm event having a 50-year or a 100-year return period. Likewise, the openings of the respective surge chambers may be sized so that the maximum discharge rate of each surge chamber (or the cumulative discharge rate of the surge chambers) corresponds to the discharge rate permitted for storm events of specific return periods. The detention system 10 may include any number of surge chambers and associated storage chambers having respective detention volumes that, in some embodiments, are each sized to allow the detention system to accommodate a storm event of specified return period.

Figure 5:
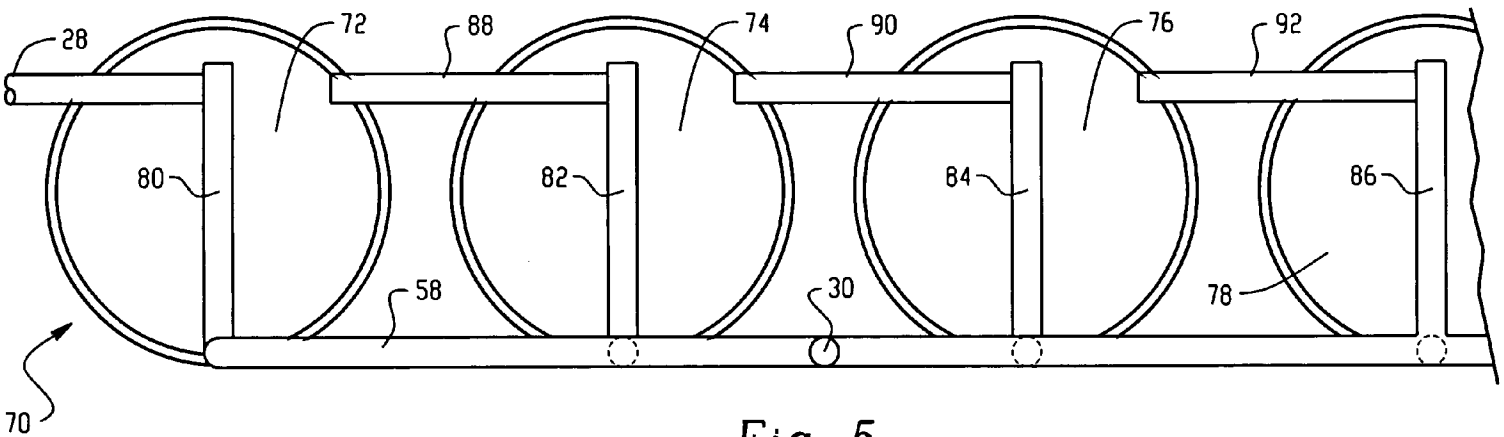
FIG. 5 is a diagrammatic, section illustration of an embodiment of a stormwater detention system.
Figure 5A:
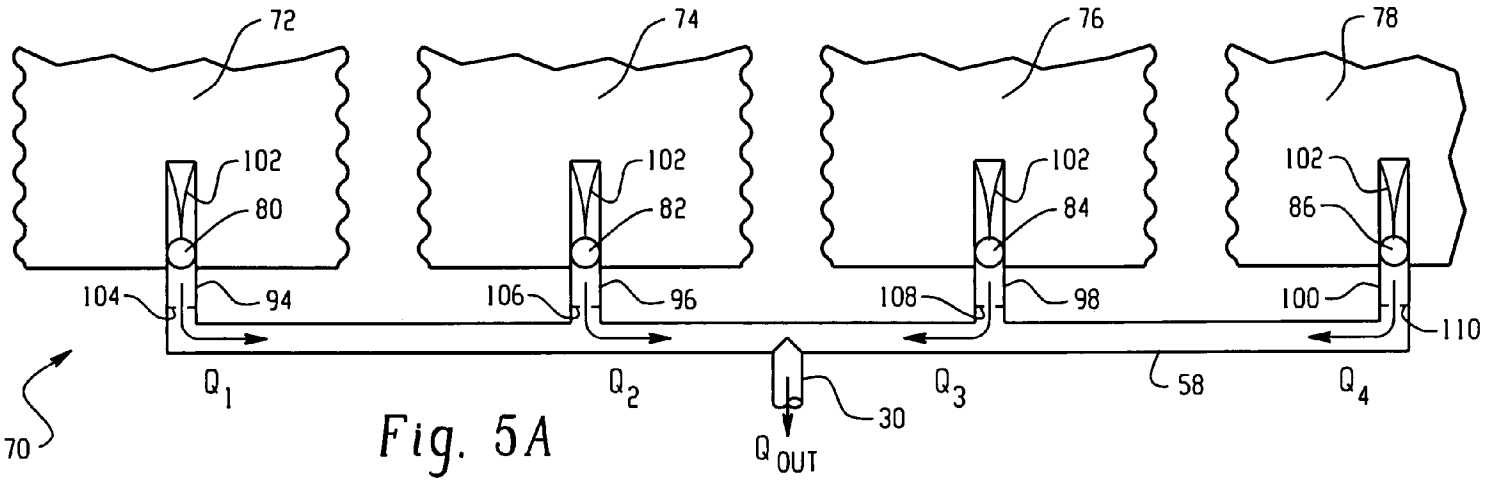
FIG. 5A is a top, section view of the stormwater detention system of FIG. 5.

In an alternative embodiment, referring to FIGS. 5 and 5A, a detention system 70, functioning in a fashion similar to that described above with respect to FIGS. 1–4, includes a series of individual, parallel storage chambers 72, 74, 76 and 78 each having a respective surge chamber 80, 82, 84 and 86 disposed therein. The first surge chamber 80 receives stormwater runoff from primary inlet 28 and the second, third and fourth surge chambers 82, 84, 86 are connected to respective adjacent storage chambers 72, 74, 76 via fluid passageways 88, 90 and 92 extending therebetween.

Referring to FIG. 5A, the storage chambers 72, 74, 76, 78 of detention system 70 as well as the surge chambers 80, 82, 84, 86 disposed therein are capable of direct fluid communication with discharge conduit 58 via respective passageways 94, 96, 98 and 100. Large diameter corrugated metal pipe, or any other suitable material may form the storage chambers. A platypus bill valve 102 (or any other suitable one-way valve, such as a gate valve) controls stormwater flow from the storage chambers 72, 74, 76 and 78 to the discharge conduit 58. Disposed downstream of the valves 102 and surge chambers 80, 82, 84, 86 are flow control outlets 104, 106, 108 and 110 having openings of fixed dimension that are sized to discharge stormwater from both the respective surge and storage chambers at respective flow rates $Q_1$, $Q_2$, $Q_3$, $Q_4$, as the surge chambers successively fill. While the orifices 104, 106, 108 and 110 are shown located in passageways 94, 96, 98 and 100, alternatively, they could be located in the discharge conduit 58. In the latter case, by way of example, orifice 106 may set the maximum combined flow rate permitted from surge chambers 80 and 82.

Figure 6:
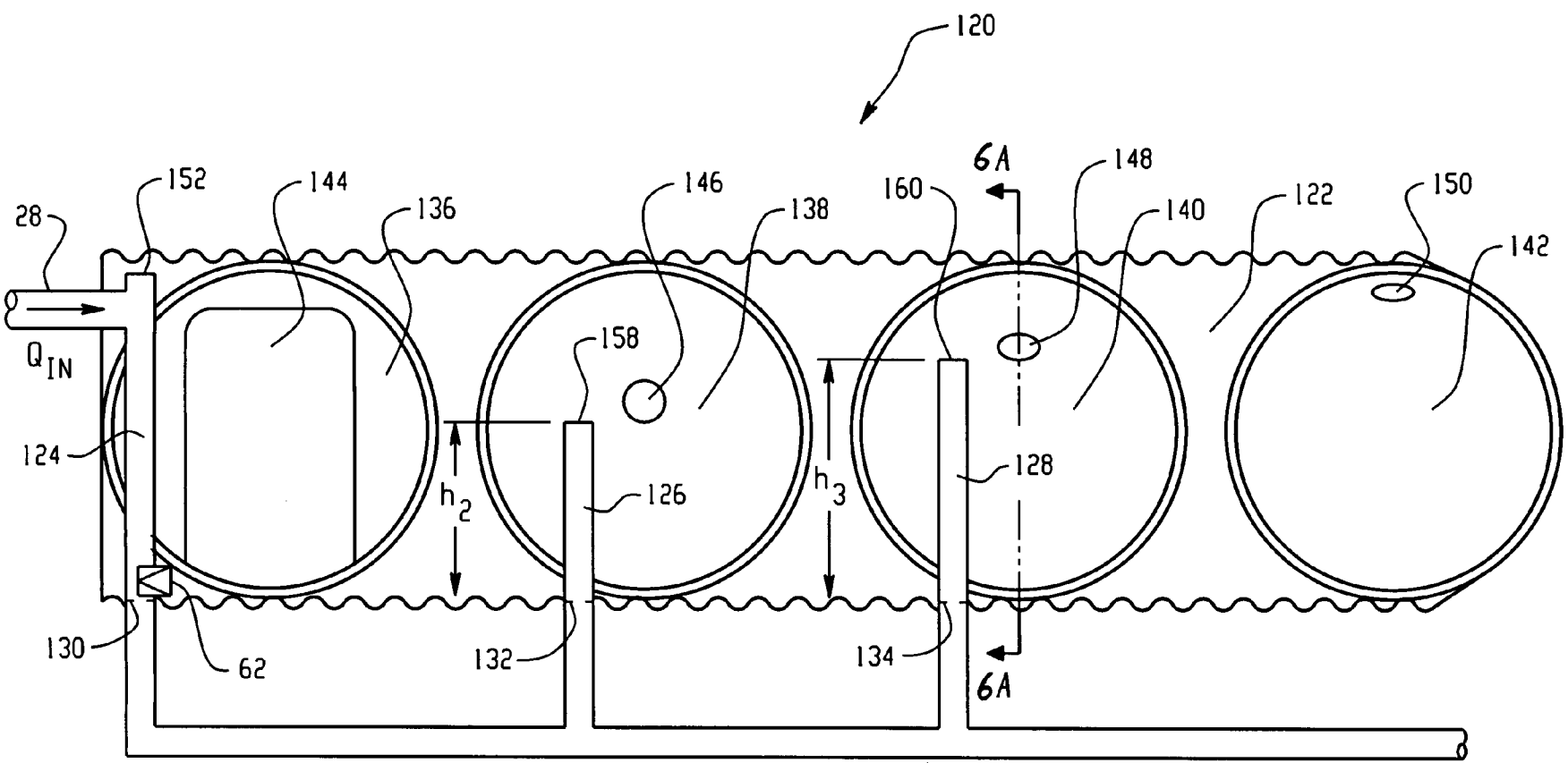
FIG. 6 is a diagrammatic, section illustration of another embodiment of a stormwater detention system.
Figure 6A:
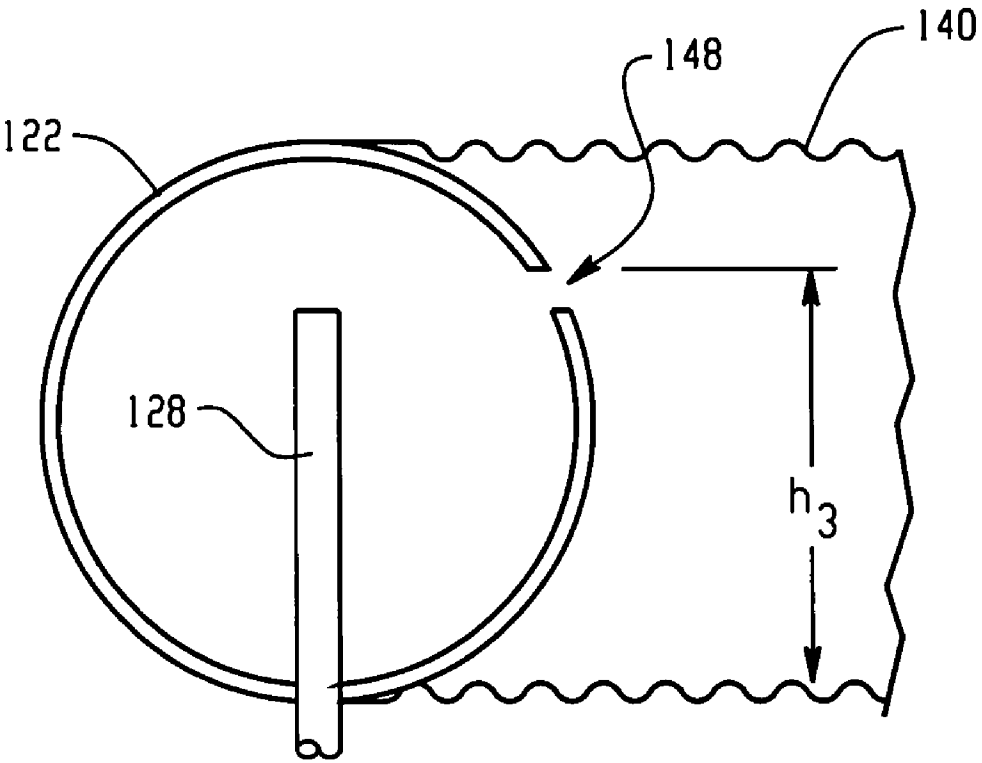
FIG. 6A is a side, section view of a storage chamber along line A—A of FIG. 6.

FIGS. 6 and 6A illustrate another embodiment of a stormwater detention system 120 that allows hydraulic head to increase beyond a peak level associated with a surge chamber after stormwater directed into a storage chamber, at least partially dedicated to a storm event of pre-selected return period, reaches a predetermined level. Detention system 120 includes a header chamber 122, multiple surge chambers 124, 126, 128 located in the header chamber 122 that have respective discharge outlets 130, 132, 134 with openings of fixed dimension, a primary inlet 28 in communication with first surge chamber 124 and multiple storage chambers 136, 138, 140, 142 capable of communicating with the header chamber through respective storage chamber inlets 144, 146, 148, 150.

Each of the storage chamber inlets 144, 146, 148 and 150 are located at differing elevations within the header chamber 122 to begin receiving stormwater at a particular stormwater level. Inlet 144 of the first storage chamber 136 is relatively large compared to inlets 146 and 148 and extends from a location near the bottom of the header chamber 122 to a location near the top of the header chamber. Inlets 146 and 148 are disposed above and aligned respectively with the top openings into the second and third surge chambers 126 and 128 (see FIG. 6A) and storage inlet 150 is positioned at an elevation above the storage inlets 146 and 148. Surge chamber 124 includes an overflow outlet 152 having an opening of fixed dimension positioned a height h, from the bottom of the header chamber 122 (see FIG. 8). Located at the top of each of the second and third surge chambers 126 and 128 are surge chamber inlets 158, 160 also having openings of fixed dimension. Inlets 158, 160 are sized and positioned to allow stormwater to enter the surge chambers 126 and 128 as the stormwater level in the header chamber 122 rises to heights $h_2$ and $h_3$, respectively. To inhibit vortex formation, a cross or other vortex-limiting apparatus can be disposed in the surge chambers 126, 128.

Figure 7:
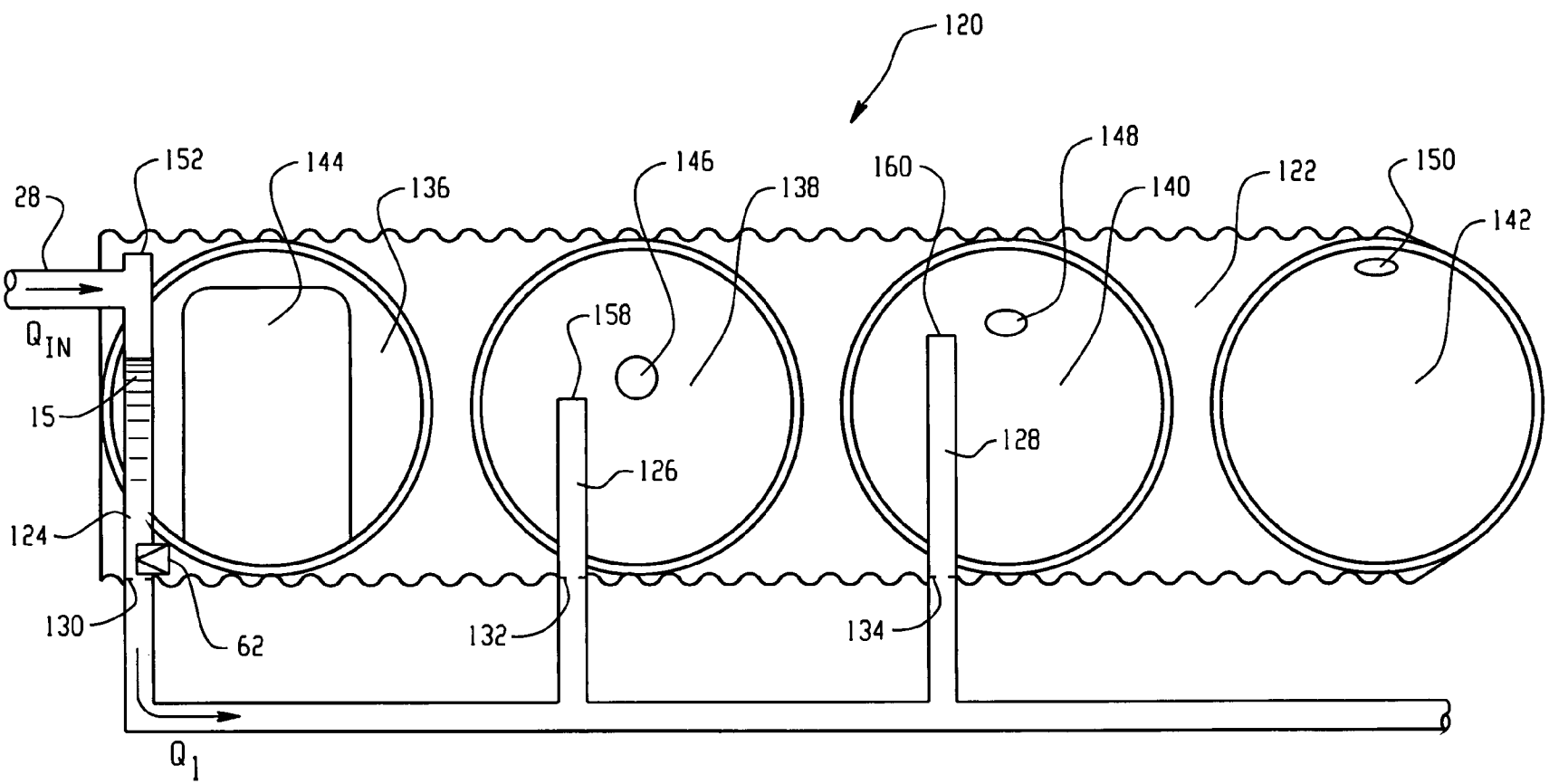
FIGS. 7–9 are section illustrations of the stormwater detention system of FIG. 6 in use.
Figure 8:
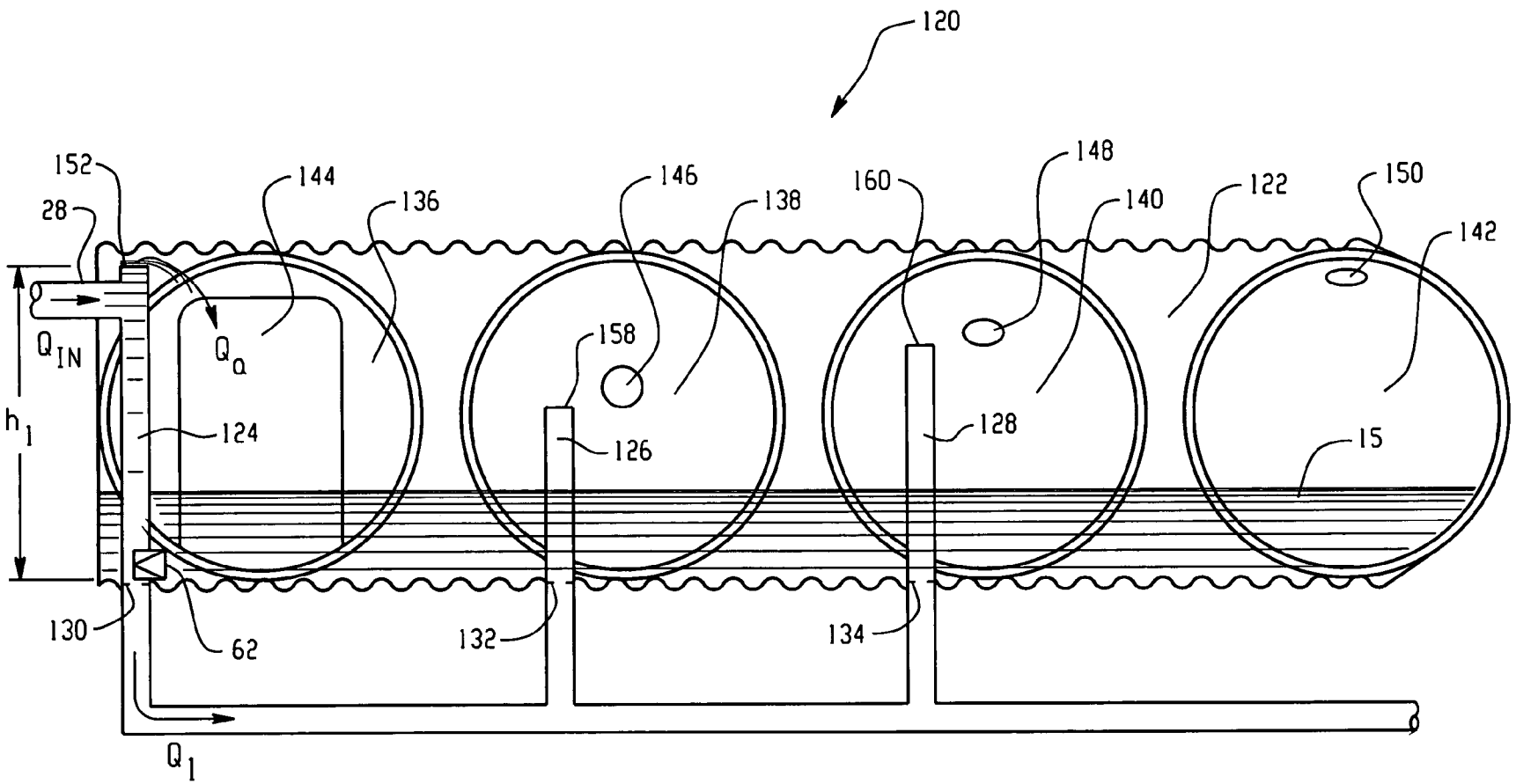
Figure 9:
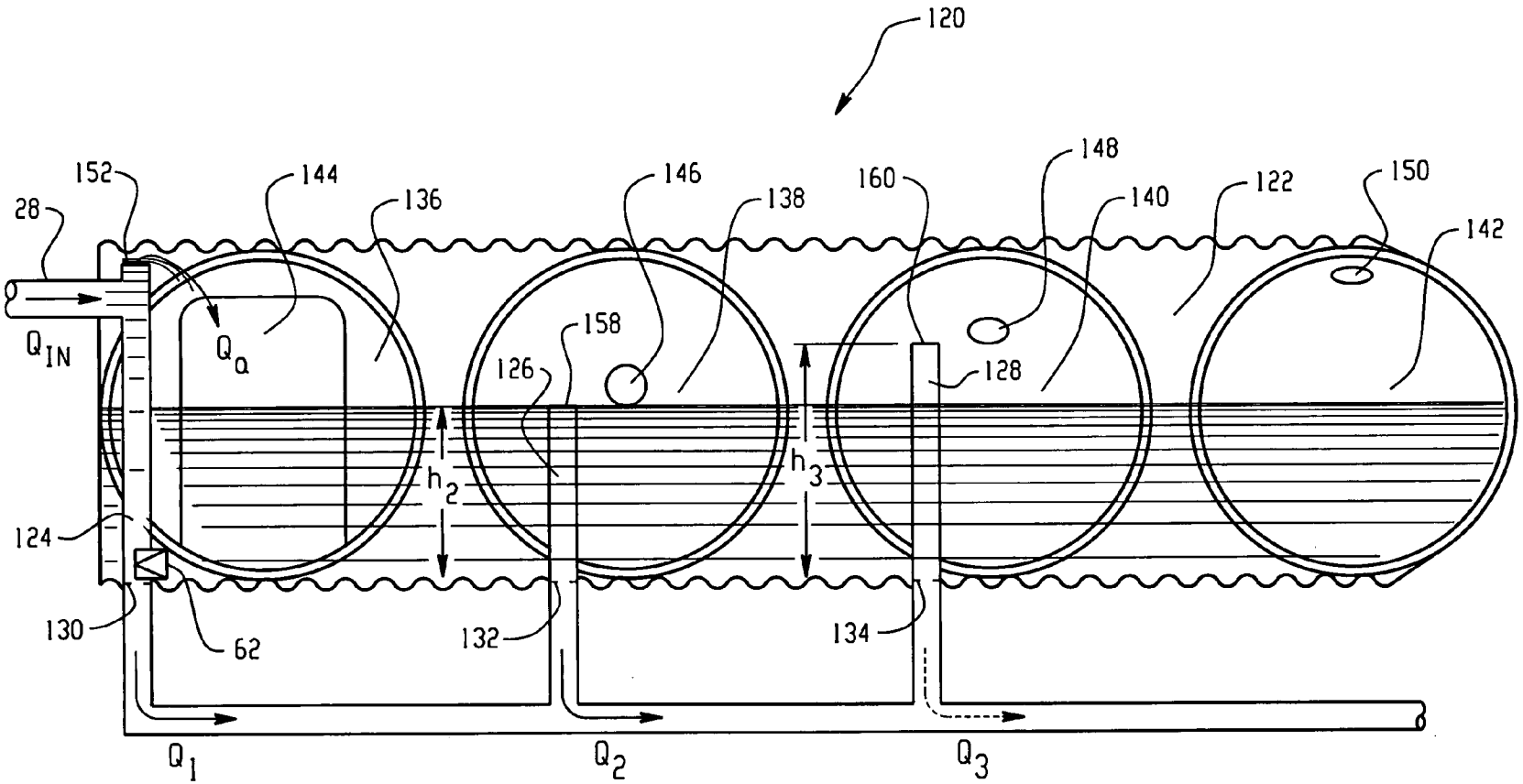

FIGS. 7–9 show the stormwater detention system 120 during use. Referring to FIG. 7, as stormwater flows from the primary inlet 28 into the first surge chamber 124 at a flow rate $Q_{in}$, stormwater is discharged from the surge chamber 124 through the outlet 130 at a flow rate $Q_1$, bypassing the header chamber 122. At relatively low stormwater inflow rates (e.g., from storm events of relatively frequent return periods), most, if not all, of the stormwater received in surge chamber 124 is discharged directly through the outlet 130, bypassing the header chamber 122 and the storage chambers 136, 138, 140, 142. As shown, at higher inflow rates the outlet 130 is sized such that the surge chamber 124 fills with stormwater 15, increasing both the hydraulic head and the discharge rate $Q_1$ through the outlet 130.

Referring now to FIG. 8, certain more intense storms (e.g., from storm events of relatively less frequent return periods) result in stormwater overflow from the surge chamber 124 at a flow rate $Q_a$ ($Q_a=Q_{in}-Q_1$) filling the header chamber 122 while stormwater discharges from surge chamber 124 at $Q_1$. As the header chamber 122 fills, stormwater from the header chamber flows through storage inlet 144 and into the storage chamber 136.

If the storm has a high enough intensity and flow volume, the storage chamber 136 and the header chamber 122 continues to fill with stormwater 15 to a level where, referring to FIG. 9, stormwater flows into second surge chamber 126 through inlet 158. As second surge chamber 126 fills, stormwater is discharged from the second surge chamber 126 through discharge outlet 132 at a flow rate $Q_2$, automatically increasing the total flow rate $Q_{out}$ from the detention system. At certain stormwater inflow rates into the surge chamber 126, most, if not all of the stormwater received in the surge chamber 126 is discharged directly through outlet 132. At higher inflow rates, the outlet 132 is sized such that the surge chamber 126 fills with stormwater 15 increasing both the hydraulic head and the discharge rate $Q_2$ through the outlet 132.

For storms having a high enough intensity and flow volume, the stormwater level in the header chamber 122 (and the first storage chamber 136) may continue to rise flowing through the storage inlet 146 and into storage chamber 138. In some cases, the detention system fills to a level where stormwater flows into third surge chamber 128 through inlet 160 in a fashion similar to that described with regard to surge chamber 126. As the surge chamber 128 fills, stormwater is discharged from the third surge chamber through discharge outlet 134 at a flow rate $Q_3$ (shown by dotted lines), automatically increasing $Q_{out}$. As the water level continues to rise, additional detention volume in the storage chambers is utilized. In some embodiments, the detention system 120 can be sized to accommodate a storm event having a ten-year or 25-year return period before the stormwater level reaches inlet 160.

If the stormwater level in the detention system 120 rises from $h_2$ to $h_3$, the hydraulic head affecting $Q_2$ increases. For example, with $h_2$ being about five feet and $h_3$ being about six feet $Q_2$ may increase by about 9.5 percent as the hydraulic head increases from $h_2$ to $h_3$. Similarly, if the stormwater level rises above $h_3$, the hydraulic head affecting both $Q_2$ and $Q_3$ increases. For example, $Q_2$ may increase by about 26 percent and $Q_3$ may increase by about 13 percent as the hydraulic head approaches eight feet with $h_2$ being about five feet and $h_3$ being about six feet. As another example, $Q_2$ may increase by about 15 percent and $Q_3$ may increase by about seven percent as the hydraulic head approaches eight feet with $h_2$ being about six feet and $h_3$ being about seven feet. Such hydraulic head increases can be taken into account when sizing the discharge outlets 132 and 134 so that maximum permitted flow rates (as set by local code or regulation for example) are not exceeded for any given storm event.

As can be seen by FIGS. 8 and 9, $Q_1$ remains unaffected by the increasing hydraulic head in the detention system 120 as the water level in the header chamber 122 increases to $h_2$ (and to $h_3$) due to the height $h_1$ to the outlet 152 of the first surge chamber 124. This provides a relatively constant stormwater discharge rate through the outlet 130 as stormwater overflows into the header chamber 122.

The inlet height of the second and third surge chambers ($h_2$ and $h_3$) can be selected so that the final storm's maximum discharge (e.g., for a 100-year storm) is matched by the combined flow rate out of the three surge tanks as the stormwater level rises to the top of the storage units 136, 138 and 140. Any remaining inflow can spill over into storage unit 142. In an embodiment where $h_2$ is five feet and $h_3$ is six feet, assuming an eight-foot diameter head chamber 122 and eight-foot diameter storage chambers 136, 138 and 140 of equal lengths, and the final storm stage discharge is acceptable, about 24 percent of storage capacity of chambers 122, 136, 138 and 140 is available for the final or largest storm event. As another example, in an embodiment where $h_2$ is six feet and $h_3$ is seven feet, assuming an eight-foot diameter chambers 122, 136, 138 and 140, and the final storm stage discharge is acceptable, about seven percent of storage capacity of chambers 122, 136, 138 and 140 is available for the largest storm event. Header chamber 122 can include a valve 62, such as a flap gate, platypus valve, etc. to allow for discharge of stormwater from the header chamber 122. The storage chambers can empty in a fashion similar to those described above, for example, using platypus valves, flap gates, etc.

Figure 10:
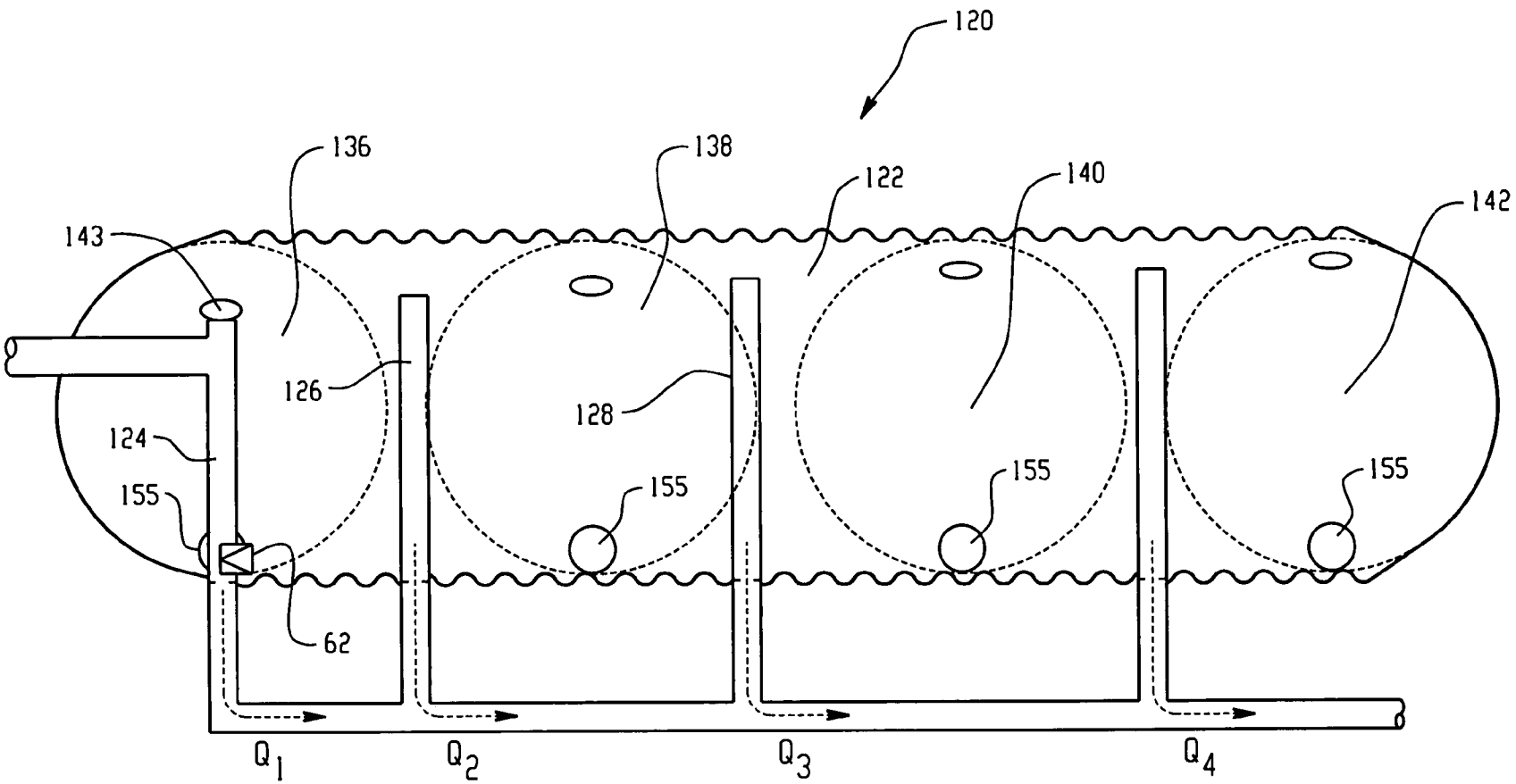
FIG. 10 is a diagrammatic view of a variation of the stormwater detention system of FIG. 6.

FIG. 10 illustrates a variation of FIG. 6 that also optimizes, at least to some degree, storm water discharge from the detention system 120, e.g., once the storm event is over. This can allow the detention system 120 to rapidly discharge stormwater and, for example, accommodate another storm event. In this embodiment, the storage chambers 136, 138, 140, 142 having increasing detention volumes and each include inlet openings 143 at differing elevations and a flap gate 155 or other pressure responsive valve that allows communication from the associated storage chamber to the header chamber 122. The flap gates 155 are set to open at differing differential pressures to allow stormwater flow from the associated relatively large storage chamber 136, 138, 140, 142 to the relatively small header chamber 122. As the stormwater level in the header chamber 122 decreases, a differential head is developed at the flap gates 155, opening the flap gates, for example, in succession. Because the storage chambers 136, 138, 140, 142 are relatively large compared to the header chamber 122, the storage chambers can maintain a predetermined water level in the header chamber so that stormwater is rapidly discharged from the detention system 120 at controlled rates. In some embodiments, the storage chambers can have differing detention volumes.

FIGS. 11–16 illustrate stormwater detention systems that include multiple surge chambers that are each in communication with a common storage chamber and/or other detention volume, such as a pond. This approach can allow the detention system layout to be strictly site dependent without any need to predict and provide appropriately sized storage chambers for each design storm.

Figure 11:
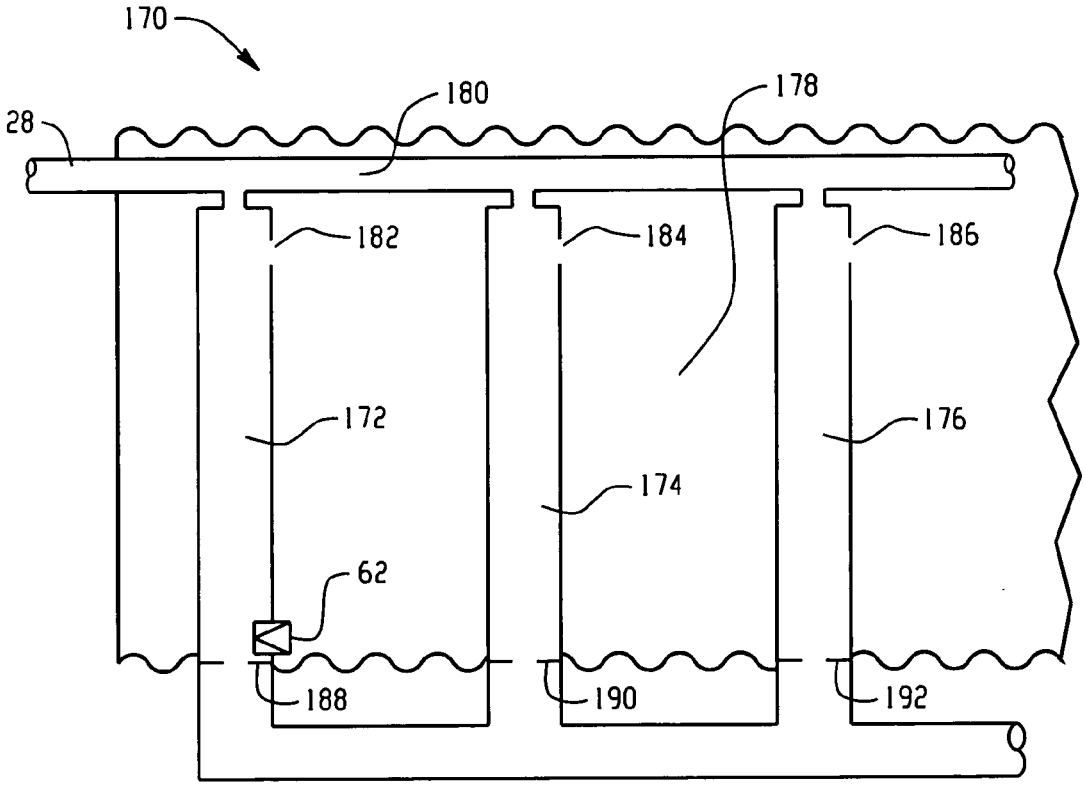
FIG. 11 is a diagrammatic, section view of another embodiment of a stormwater detention system.
Figure 11A:
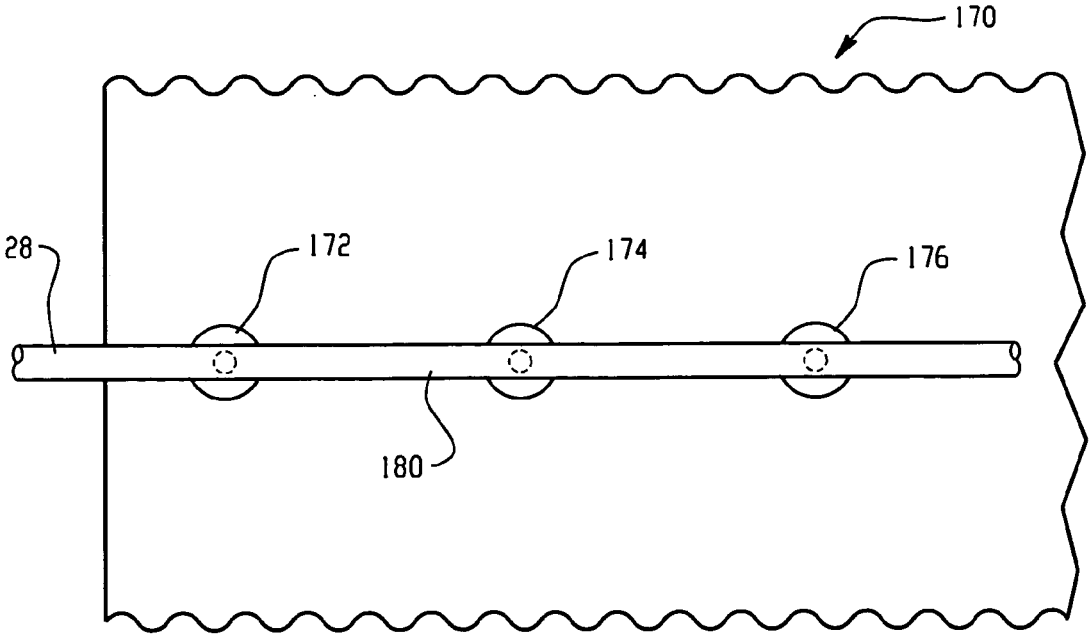
FIG. 11A is a top, section view of the stormwater detention system of FIG. 11.

Referring to FIGS. 11 and 11A, stormwater detention system 170 includes surge chambers 172, 174 and 176 disposed within storage chamber 178. Each surge chamber 172, 174, 176 is capable of communicating with primary inlet 28 via inlet passageway 180 (which in one example is a pipe/conduit) and includes a respective surge overflow outlet 182, 184 and 186 having openings of fixed dimension that allow overflow from the surge chambers to the storage chamber 178 and a respective discharge outlet 188, 190 and 192 having an opening of fixed dimension allowing stormwater discharge to the receiving environment. The storage chamber 178 can include a valve 62, such as flap gate, platypus valve, etc. to discharge stormwater within the storage chamber at an allowable discharge rate and to empty within a desired time period. The outlets 182, 184 and 186 may be located at the same elevation (as shown) or the outlets 182, 184, 186 may be located at differing elevations, such as outlet 190 being located above outlet 188 and outlet 192 being located above outlet 190.

Figure 12:
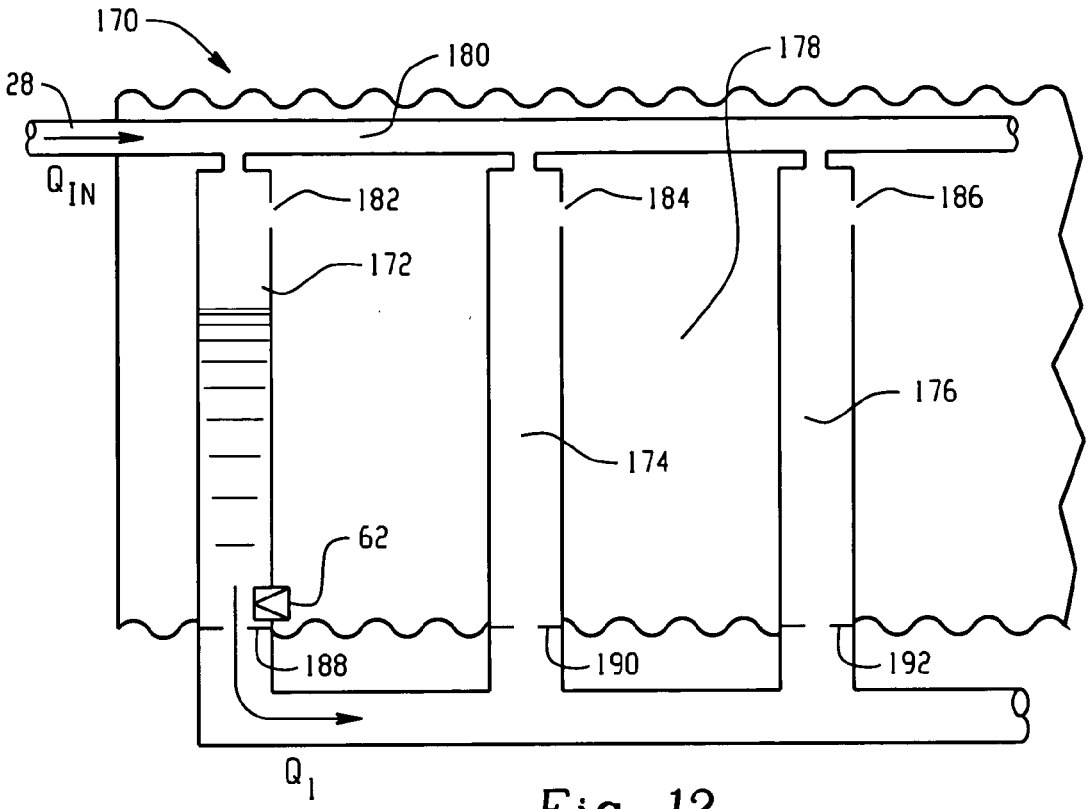
FIGS. 12 and 13 are section illustrations of the stormwater detention system of FIG. 11 in use.
Figure 13:
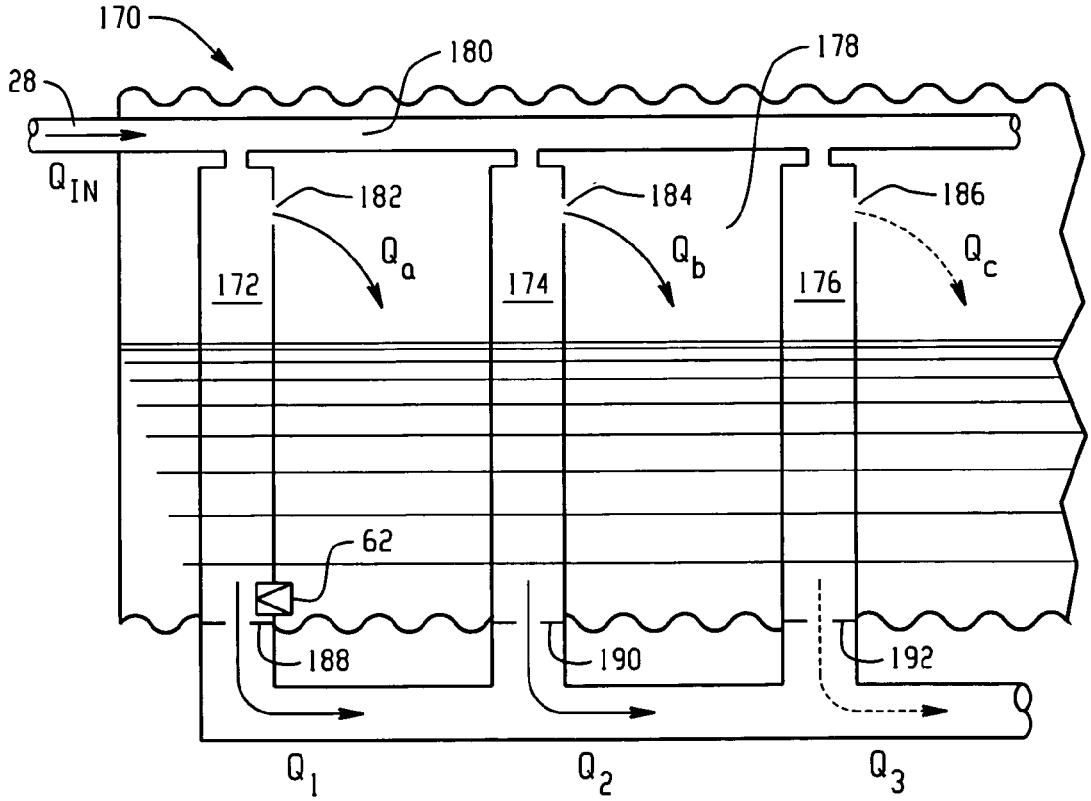

FIGS. 12 and 13 show the detention system 170 during use. Referring to FIG. 12, as stormwater flows from the primary inlet 28 into the first surge chamber 172 at a flow rate $Q_{in}$, stormwater is discharged from the surge chamber 172 through the surge outlet 188 at a flow rate $Q_1$, bypassing the storage chamber 178. Surge chamber 172 is sized such that most, if not all, the stormwater will flow into the surge chamber 172 until its capacity is reached. At relatively low stormwater inflow levels, most, if not all, of the stormwater received in surge chamber 172 is discharged directly through the outlet 188, bypassing the storage chamber 178. As shown, at higher inflow levels, the outlet 188 is sized such that the surge chamber 172 fills, increasing both the hydraulic head and the discharge rate through the outlet 188.

Referring to FIG. 13, certain intense storms result in stormwater overflow from the surge chamber 172 into the storage chamber 178 at a flow rate $Q_a$ while stormwater continues to discharge at flow rate $Q_1$ from surge chamber 172. If stormwater inflow is sufficiently high (e.g., greater than $Q_1+Q_a$), the surge chamber 172 fills and stormwater flows along passageway 180 to the second surge chamber 174. Similar to surge chamber 172, stormwater is discharged from the second surge chamber 174 through discharge outlet 190 at a flow rate $Q_2$ as stormwater is received within surge chamber 174, automatically increasing the total flow rate $Q_{out}$ from the detention system. Additionally, when the stormwater level in the second surge chamber 174 reaches outlet 184, stormwater is discharged into the storage chamber 178 at a flow rate $Q_b$. The above process can repeat for the third surge chamber 176, e.g., automatically increasing $Q_{out}$ by adding $Q_3$ from the third surge chamber 186 (shown by dotted lines).

Figure 14:
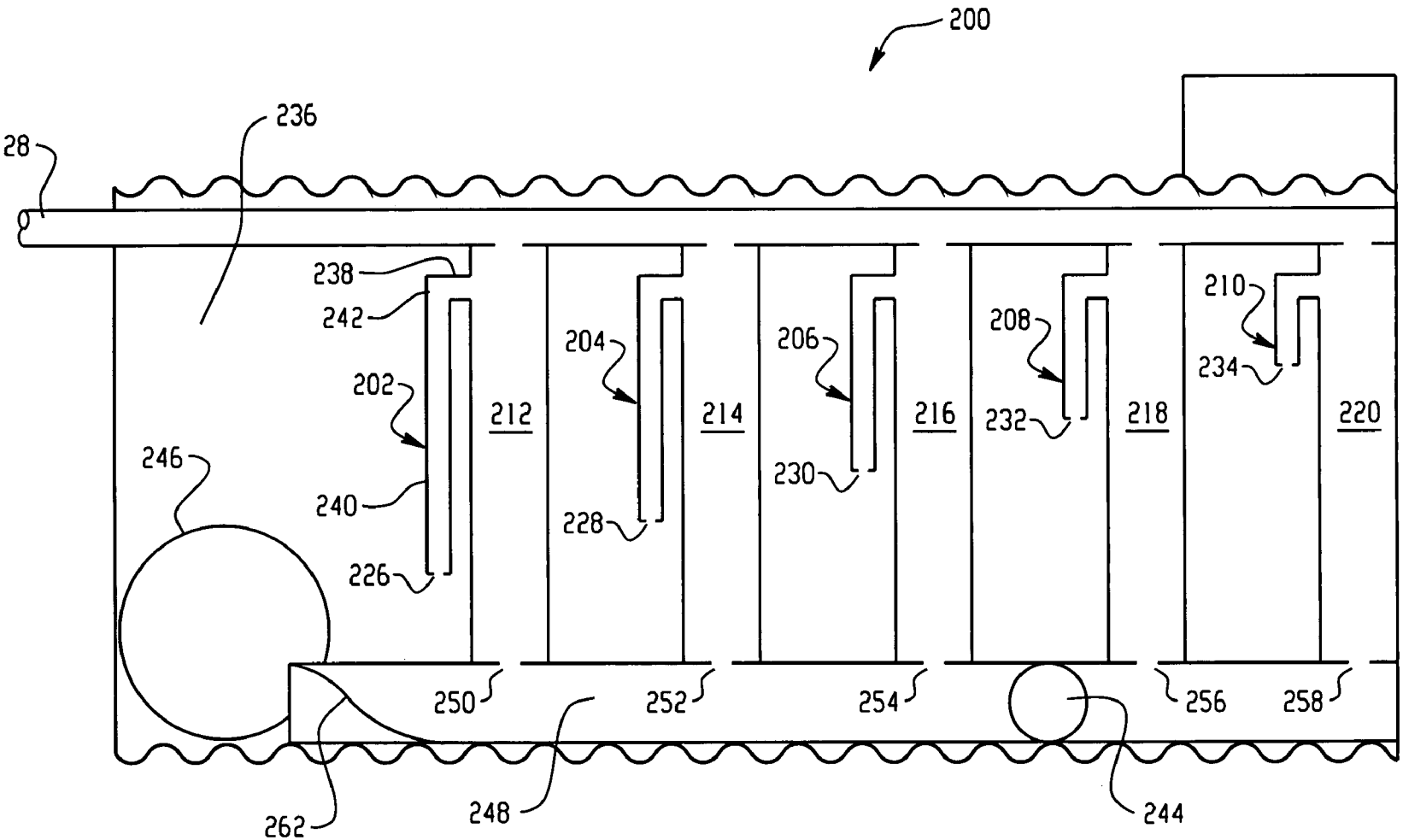
FIG. 14 is a diagrammatic, section illustration of another embodiment of a stormwater detention system.
Figure 14A:
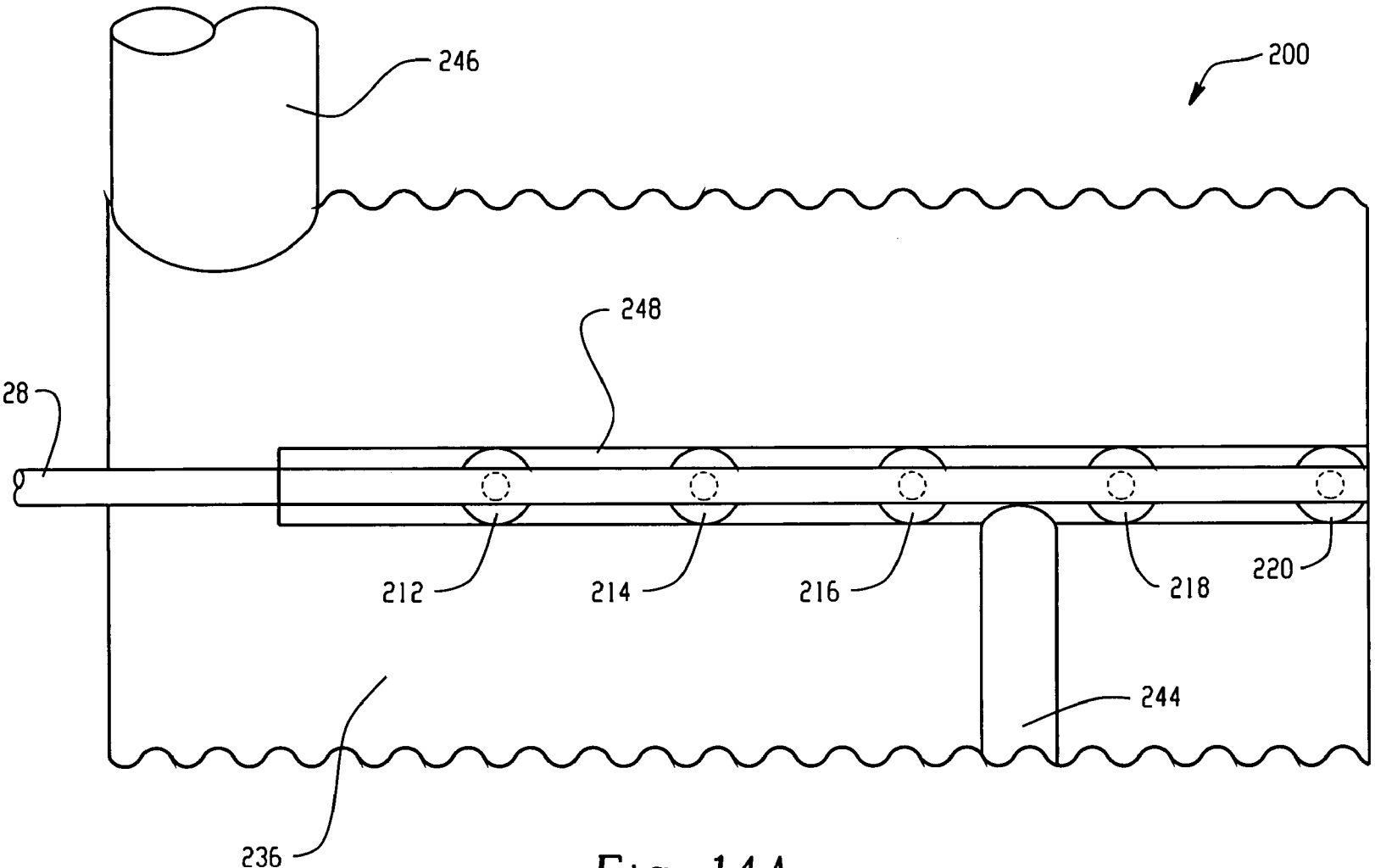
FIG. 14A is a top, section view of the stormwater detention system of FIG. 14.
Figure 14B:
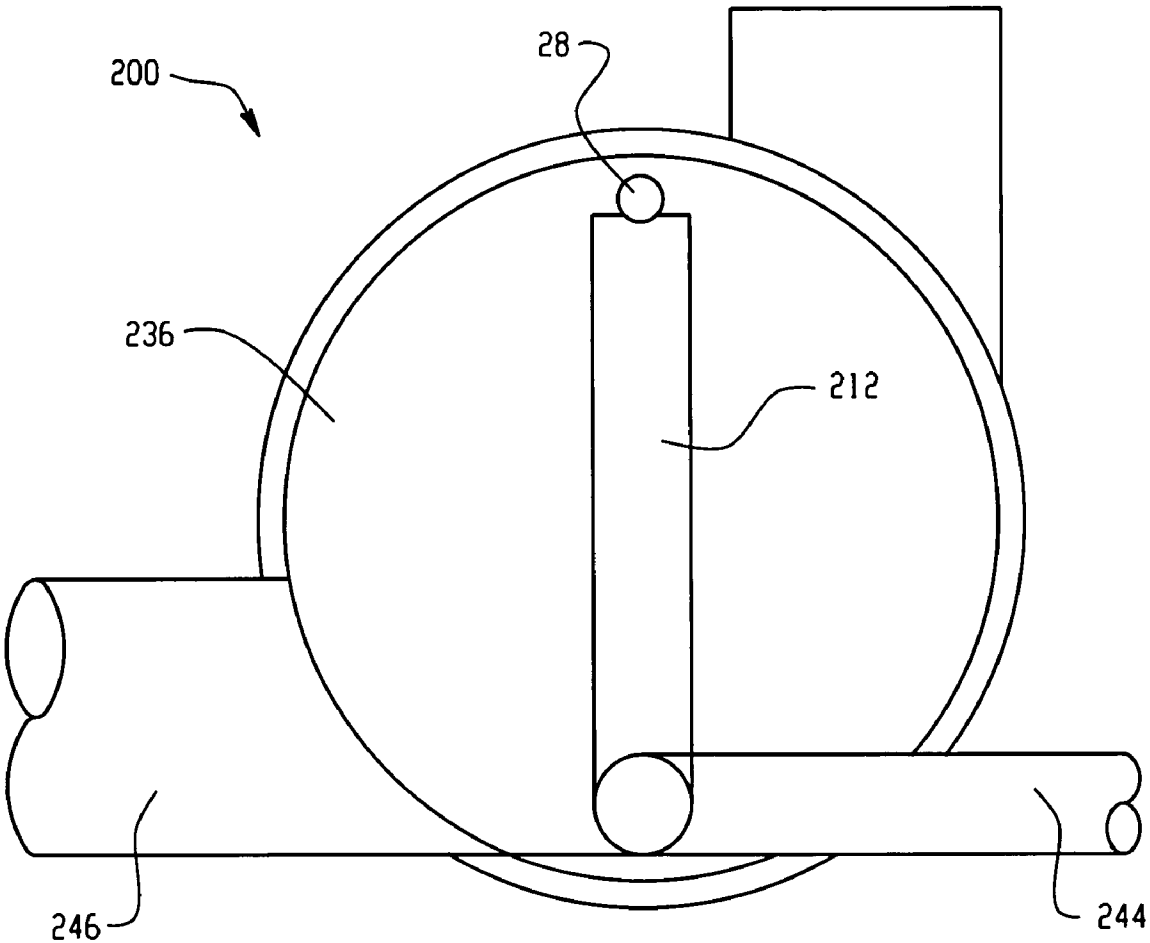
FIG. 14B is an end, section view of the stormwater detention system of FIG. 14.

Referring now to FIGS. 14–14B, a stormwater detention system 200, similar to that described above with respect to FIGS. 11–13, includes outlet passageways (as may be formed by pipes/conduits) 202, 204, 206, 208 and 210 forming spouts of varying lengths extending from respective surge chambers 212, 214, 216, 218, 220 to provide surge chamber overflow outlets 226, 228, 230, 232 and 234 having openings or fixed dimension disposed at differing elevations within the common storage chamber 236. The outlet passageways 202, 204, 206, 208, 210 each include a relatively horizontal portion 238 and a relatively vertical portion 240 connected by a bend 242. Alternatively, the spouts forming outlet passageways 202, 204, 206, 208, 210 may not include a relatively horizontal portion and the vertical portion 240 can be connected to the respective surge chambers 212, 214, 216, 218, 220 at bend 242. The vertical portions 240 extend to the differing elevations, which can provide controlled stormwater flow from the surge chambers 212, 214, 216, 218, 220 to the storage chamber 236 as the stormwater level rises in the storage chamber. As shown, the outlet elevations increase from the first surge chamber 212 to the fifth surge chamber 220, however, any other suitable configuration may be employed. The detention system 200 also includes a first discharge outlet 244 allowing stormwater discharge from the discharge system to the environment and a second discharge outlet 246 allowing stormwater flow to another detention receptacle (not shown), or to a detention pond.

Each surge chamber 212, 214, 216, 218, 220 is connected to the first outlet 244 via discharge passageway 248. Similar to FIG. 11 above, the surge chambers 212, 214, 216, 218, 220 each include a discharge outlet 250, 252, 254, 256, 258, 260 having an opening of fixed dimension allowing communication from the surge chambers to the discharge passageway 248 at respective flow rates $Q_1$, $Q_2$, $Q_3$, $Q_4$ and $Q_5$ and a one-way valve 262 provides communication from the storage chamber 236 to the discharge passageway.

Figure 15:
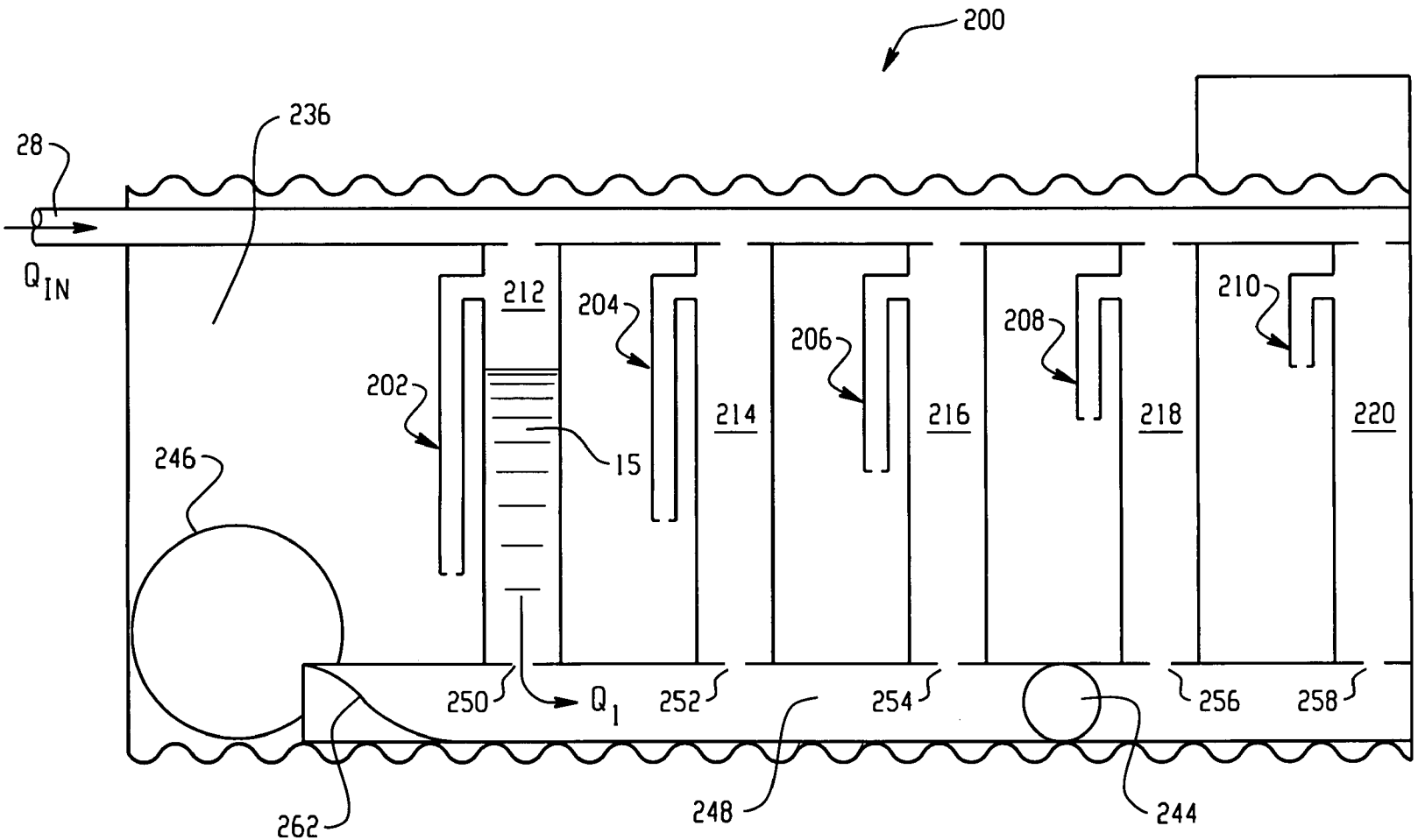
FIGS. 15 and 16 are section illustrations of the stormwater detention system of FIG. 14 in use.

Referring now to FIG. 15, as stormwater flows from the primary inlet 28 into the first surge chamber 212 at a flow rate $Q_{in}$, stormwater is discharged from the surge chamber 212 through the discharge outlet 250 at a flow rate $Q_1$, bypassing the storage chamber 236. Surge chamber 212 is sized such that most, if not all, the stormwater will flow into the surge chamber 212 until its capacity is reached. At relatively low stormwater inflow levels (e.g., from a storm event having a relatively frequent return period), most, if not all, of the stormwater received in surge chamber 212 is discharged directly through the outlet 250, bypassing the storage chamber 236. As shown, at higher inflow levels (e.g., from a storm event having a less frequent return period), the outlet 250 is sized such that the surge chamber 212 fills with stormwater 15, increasing both the hydraulic head and the discharge rate $Q_1$ through the outlet 250.

Figure 16:
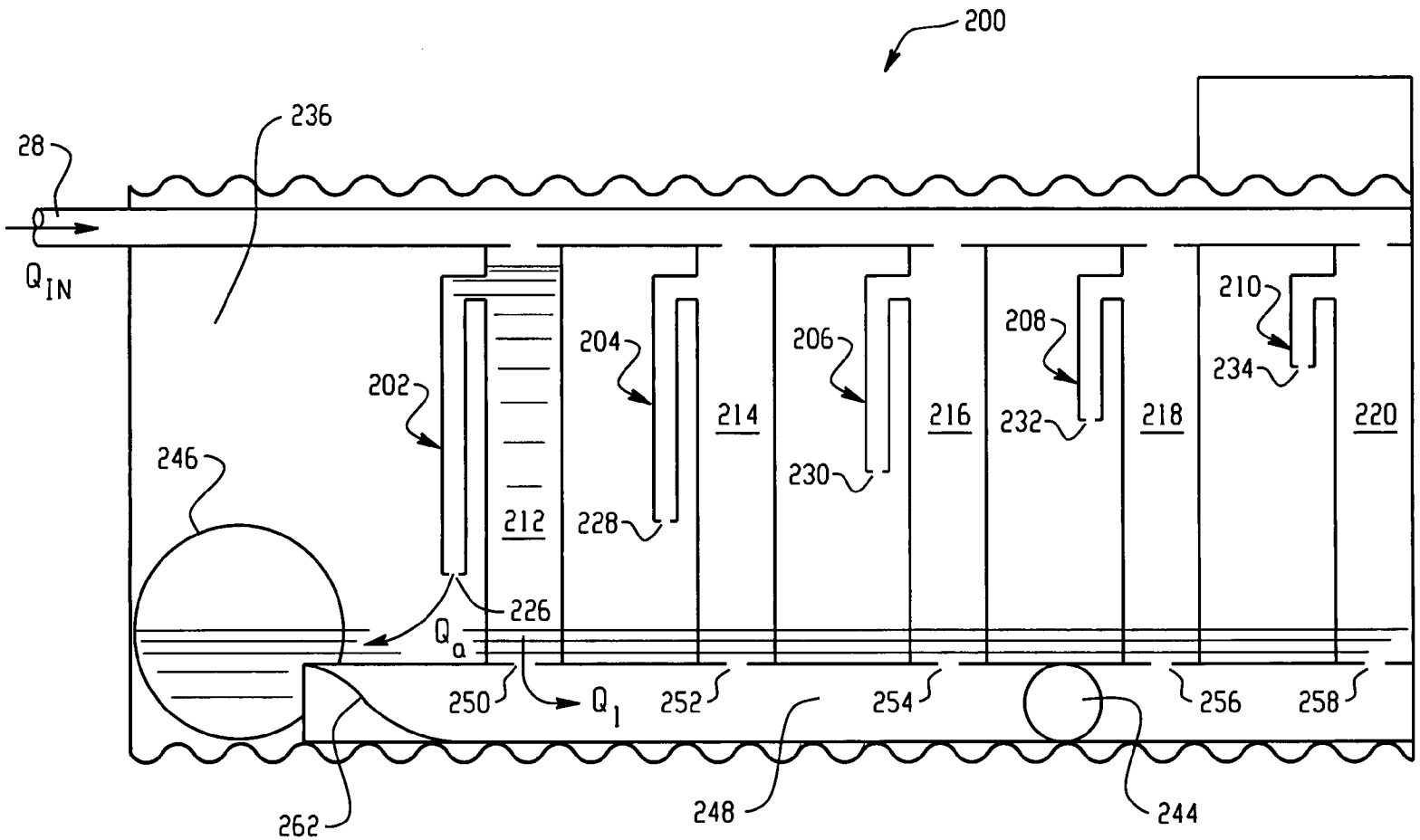

Referring to FIG. 16, certain intense storms result in stormwater overflow from the surge chamber 212 into the storage chamber 236 at a flow rate $Q_a$ while stormwater continues to discharge at flow rate $Q_1$ from surge chamber 212. As the stormwater level rises in the storage chamber 236 above the elevation of the outlet 226, the hydraulic head generated by the stormwater level in the storage chamber decreases $Q_a$ from the surge chamber 212 causing the total discharge rate from the surge chamber ($Q_a$ plus $Q_1$) to decrease. If the total discharge rate from the surge chamber 212 is less than $Q_{in}$, stormwater can flow to the second surge chamber 214 when the surge chamber 212 is filled. This process can repeat for surge chambers 216, 218 and 220, automatically increasing $Q_{out}$ by adding one or more of $Q_2$, $Q_3$, $Q_4$, $Q_5$ (shown by dotted lines) through the discharge outlet 252. Because outlet 228 is at a higher elevation than that of outlet 226, $Q_b$, $Q_c$, $Q_d$, $Q_e$ from the second, third, fourth and fifth surge chambers, when applicable, remain unaffected by stormwater level in the storage chamber 236 until the stormwater reaches a level greater than the elevations of their respective outlets 228, 230, 232, 234.

Detention system 200 can be used to provide controlled stormwater flow for use with an existing or newly developed detention pond. In some embodiments, the detention system 200 is located such that the stormwater level in the storage chamber 236 matches the stormwater level in the detention pond which is connected to the system via storage chamber outlet 246. The detention system 200 can reduce the required storage capacity of the detention pond (e.g., allowing the pond to be made smaller) by increasing the outflow capacity of the overall system to maximum permitted rates in an effective manner. In one embodiment, the detention system 200 can be incorporated as part of a buried detention unit and pond combination.

Figure 17:
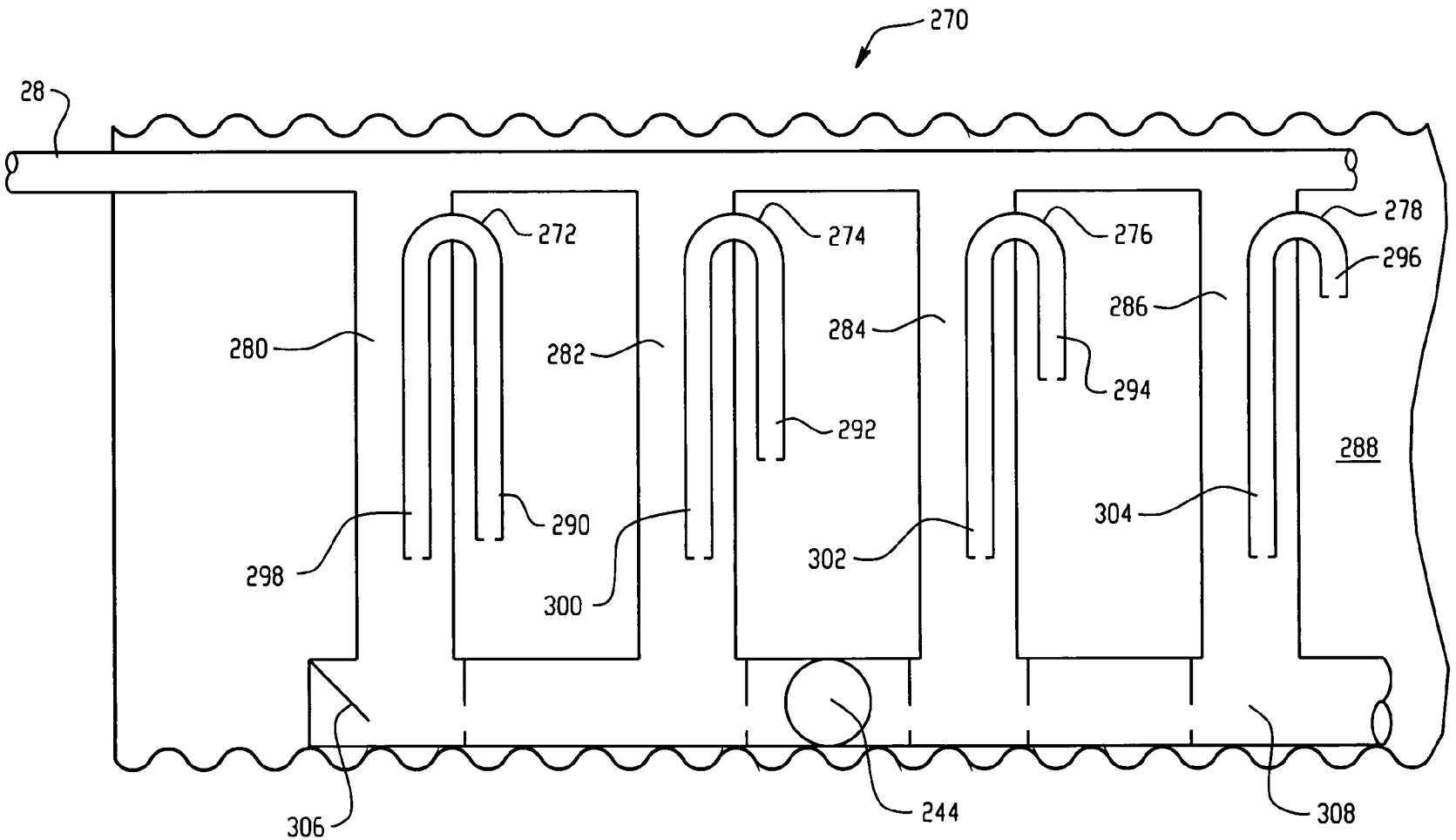
FIG. 17 is a diagrammatic, section illustration of an embodiment of a stormwater detention system.

Referring to FIG. 17, a detention system 270, similar to that described above with reference to FIG. 14, includes multiple siphons 272, 274, 276 and 278 that provide communication between respective surge chambers 280, 282, 284 and 286 and common storage chamber 288. The siphons 272, 274, 276, 278 carry stormwater from the surge chambers 280, 282, 284, 286 when the stormwater level in the respective surge chambers exceeds a bend height of the respective siphons.

Each siphon includes a first leg 290, 292, 294, 296 located outside the respective surge chamber 280, 282, 284, 286 that is shorter than a second leg 298, 300, 302, 304 located inside the respective surge chamber. Alternatively, the second leg may be shorter than the first leg of the siphon, or the legs may be of about equal length. The first legs 290, 292, 294, 296 of the siphons 272, 274, 276, 278 extend to differing elevations within the storage chamber 288 such that the stormwater level in the storage chamber can decrease flow from the surge chambers 280, 282, 284, 296 to the storage chamber in a fashion similar to that described above with respect to FIG. 14. A valve 306 (e.g., a flap gate, platypus valve, etc.) allows communication from the storage chamber 288 to discharge passageway 308. During detention system fill, the surge chambers will successively fill as in the embodiment of FIG. 14, with overflow from each surge chamber entering the storage chamber via its respective siphon. As inflow to the system stops or decreases, water can flow through the siphons from the storage chamber to the surge chambers to aid in emptying the storage chamber. With the siphon first legs positioned as illustrated, the siphoning from the storage chamber to each surge chamber will progressively stop as the water level in the storage chamber drops. Thus, siphoning into surge chamber 286 stops first, siphoning into surge chamber 284 stops next, and so on for surge chambers 282 and 280.

Figure 18:
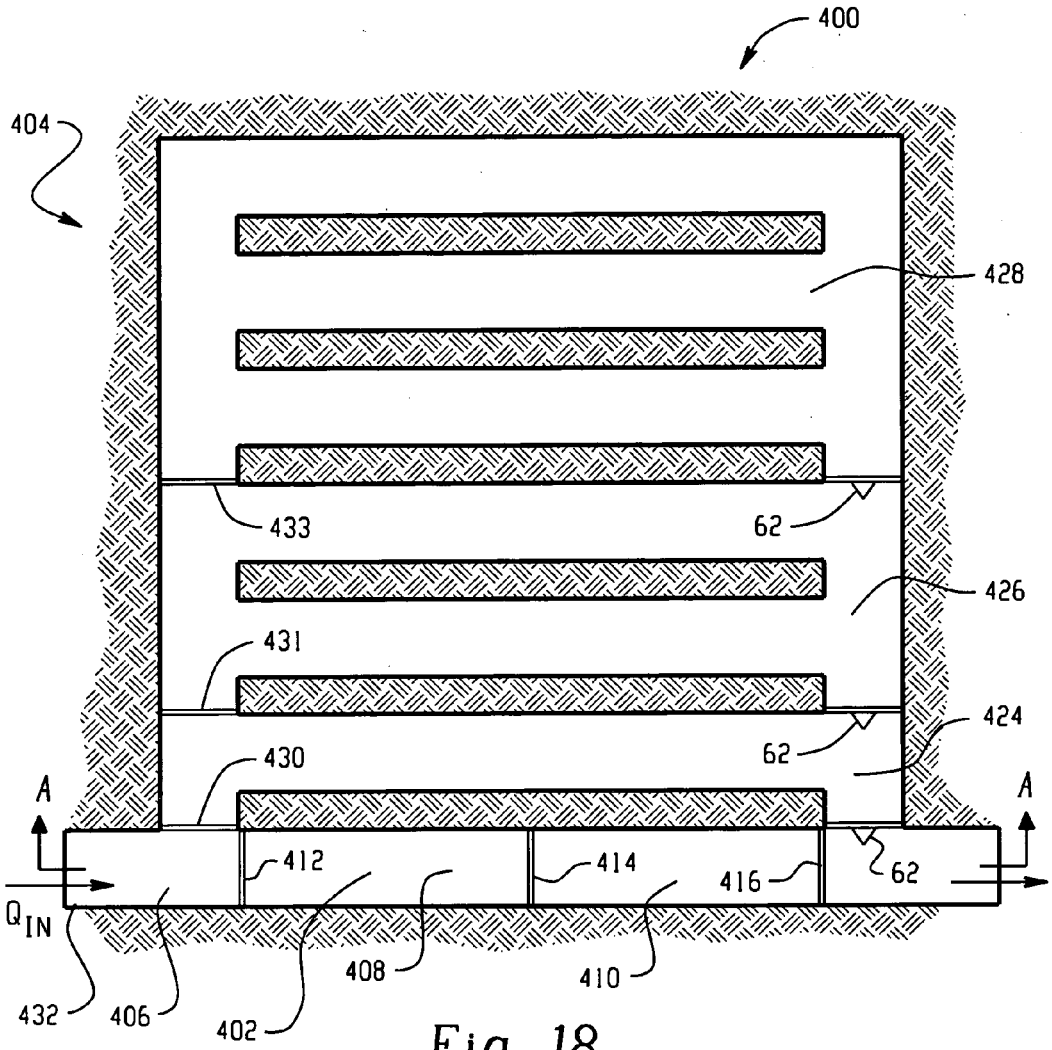
FIGS. 18–19A are diagrammatic, section illustrations of alternative stormwater detention system embodiments.
Figure 18A:
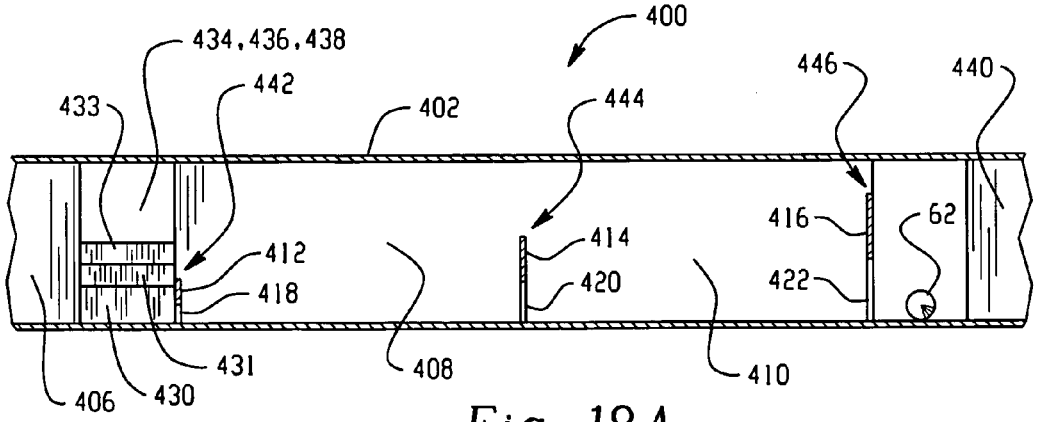
Figure 18B:
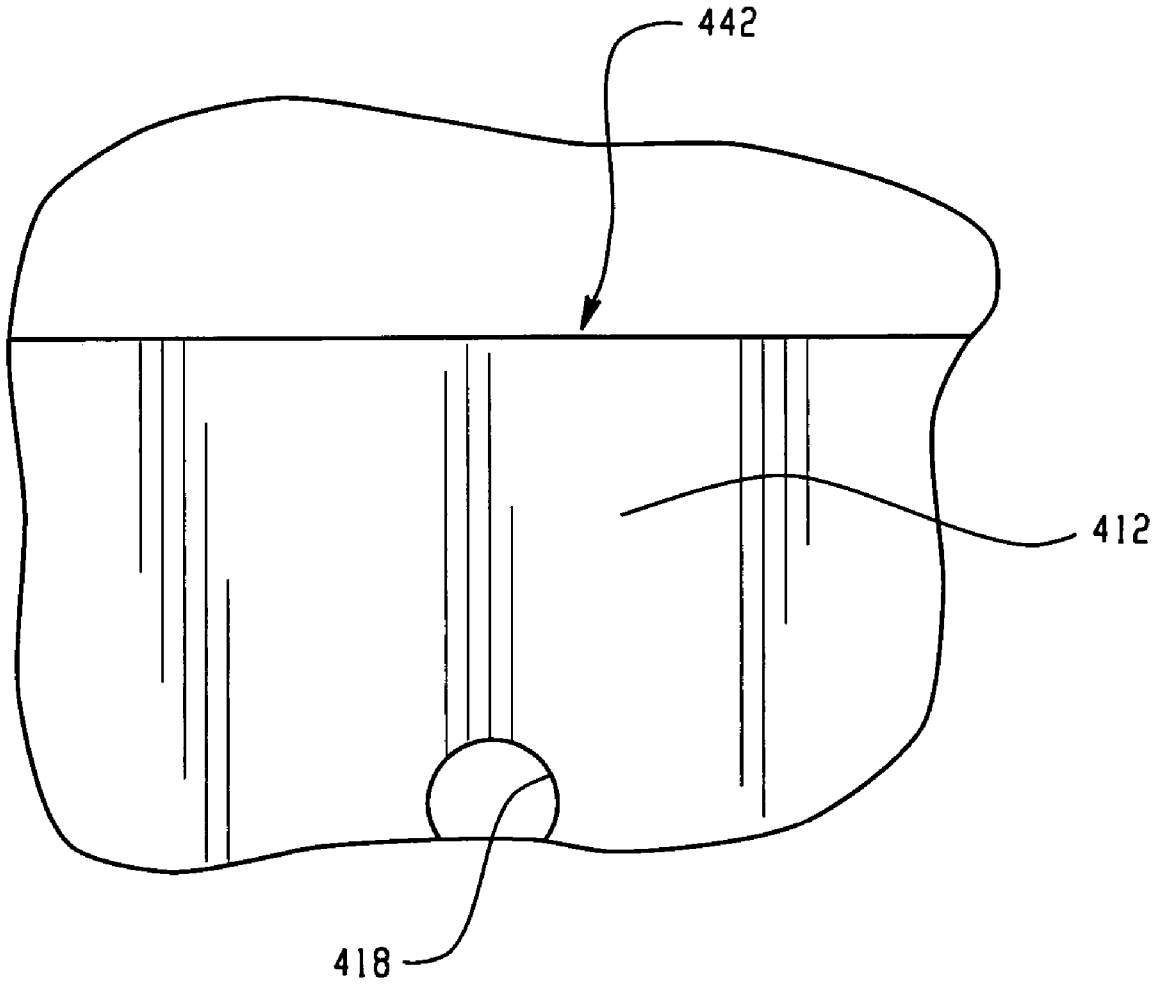
Figure 19:
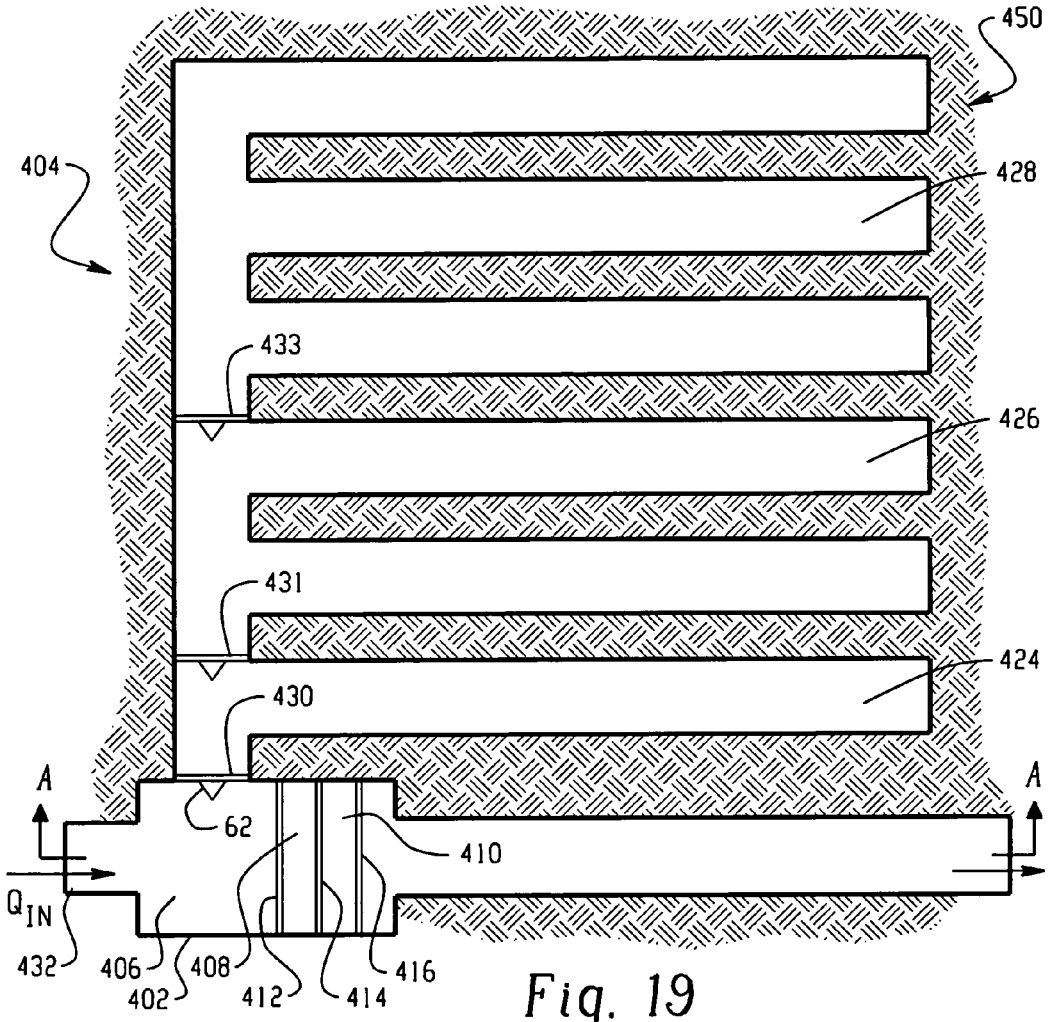
Figure 19A:
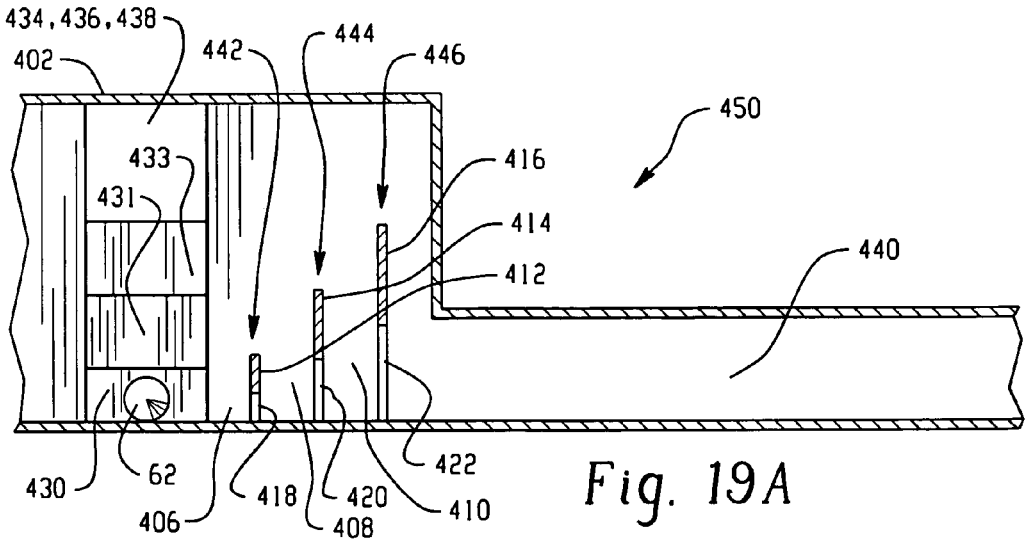

Referring now to FIGS. 18–19A, detention systems 400 and 450 include a tank 402 that is divided into multiple surge chambers and is used to regulate stormwater discharge. Tank 402 is divided into surge chambers 406, 408 and 410 by weirs 412, 414, 416 having increasing heights from the weir 412 closest to inlet 432 to the weir 416 furthest from inlet 432. Each weir 412, 414, 416 forms at least part of a respective discharge outlet 418, 420 and 422 sized to allow discharge of stormwater at a desired flow rate through discharge passageway 440 and a respective overflow outlet 442, 444 and 446 that allows stormwater to overflow from the respective surge chamber 406, 408, 410 into an adjacent volume (see FIG. 18B). The discharge outlets 418, 420 and 422 can increase in dimension from the discharge outlet closest to the inlet 432 to the discharge outlet 422 furthest from the inlet 432.

Tank 402 is connected to a set 404 of storage chambers 424, 426 and 428 by a first storage weir 430 extending substantially perpendicular to weir 412. Storage weir 430 has a height slightly less than that of weir 412 and forms a portion of a storage overflow inlet 434 into first storage chamber 424. First and second storage chambers 424 and 426 are interconnected by a second storage overflow inlet 436 formed at least in part by a second storage weir 431 having a height greater than that of weir 412 and slightly less than that of weir 414. Second storage weir 431 allows fluid overflow from first storage chamber 424 to second storage chamber 426. Second and third storage chambers 426 and 428 are interconnected by a third storage overflow inlet 438 formed at least in part by a third storage weir 433 having a height greater than that of weir 414 and slightly less than weir 416. Third storage weir 433 allows fluid overflow from second storage chamber 426 to third storage chamber 428. Valves 62, such as any suitable one-way valves, allow for fluid discharge from the storage chambers 424, 426, 428 to discharge passageway 440 (FIG. 18) and/or back to one or more surge chambers (FIG. 19).

During use, as stormwater flows from the inlet 432 into the first surge chamber 406 at a flow rate $Q_{in}$, the stormwater discharge rate $Q_1$ of the stormwater discharged from the surge chamber 406 is limited by discharge outlet 418. At relatively low stormwater inflow rates (e.g., from storm events having relatively frequent return periods), most, if not all, of the stormwater received in surge chamber 406 is discharged directly through the discharge outlet 418, bypassing the storage volumes 424, 426, 428. The discharge outlet 418 is sized such that the surge chamber 406 fills at higher inflow rates, increasing both the hydraulic head and the discharge rate through the discharge outlet 418.

More intense storms (e.g., storm events having relatively less frequent return periods) result in stormwater overflow weir 430 from the surge chamber 406 at a rate $Q_a$ into the first storage chamber 424 while stormwater continues to discharge from surge chamber 406 through discharge outlet 418 at its discharge rate $Q_1$. Storage chamber 424 can fill until the stormwater level in the storage volume chamber 424 reaches the stormwater level in the surge chamber 406 at which point the stormwater level in the storage chamber 424 and the surge chamber 406 may continue to rise until stormwater overflows weir 412 into second surge chamber 408 through outlet 442.

Similar to first surge chamber 406, as second surge chamber 408 fills, stormwater is discharged from the second surge chamber 408 through discharge outlet 420 at a flow rate $Q_2$, automatically increasing the total flow rate $Q_{out}$ from the detention system. The discharge outlet 420 is sized such that for storms of lesser return rates, the second surge chamber 408 fills increasing both the hydraulic head and the discharge rate through the discharge outlet 420.

Even more intense storms (e.g., storm events having relatively less frequent return periods) result in the stormwater level in the second surge chamber 426 to match that in the first surge chamber 406 and first storage chamber 424 at which point the stormwater level in the first storage chamber 424 rises until stormwater overflows the weir 431 through outlet 436 into second storage chamber 426, while stormwater continues to discharge from second surge chamber 408 through discharge outlet 420 at discharge rate $Q_2$. Second storage chamber 426 can fill until the stormwater level in the chamber volume 426 reaches the stormwater level in the surge chamber 408 at which point the stormwater level in the second storage chamber 426 and the second surge chamber 408 may continue to rise until stormwater overflows weir 414 into third surge chamber 410 through outlet 444. The above-described process can then repeat for the third surge chamber 412 and the third storage chamber 428.

Storage chambers 424, 426 and 428 may each be at least partially dedicated to a design storm of specified return period. For example, storage chamber 424, weir 412, weir 430 and 431 can be sized to accommodate a storm having a two-year return period. Only upon realization of a design storm having a return period of less frequent than two years may stormwater overflow weir 431 and into storage chamber 426. Likewise, stormwater may overflow weir 433 only upon realization of a storm having a 25-year return period and so on. In such a system, the storage volume for the first design storm is primarily defined by the volume in storage chamber 424 up to the height of weir 431. The additional storage volume for the second design storm is primarily defined by the volume in storage chamber 426 up to the heights of weir 433, plus the volume in storage chamber 424 above the height of weir 431 and up to the height of weir 433. The additional storage volume for the third design storm is primarily defined by the total volume in storage chamber 428, plus the volume in storage chamber 426 above the height of weir 433, plus the volume in storage chamber 424 above the height of weir 433. The detention systems 400 and 450 may be sized to accommodate a storm having a return period of 100 years.

Figure 20:
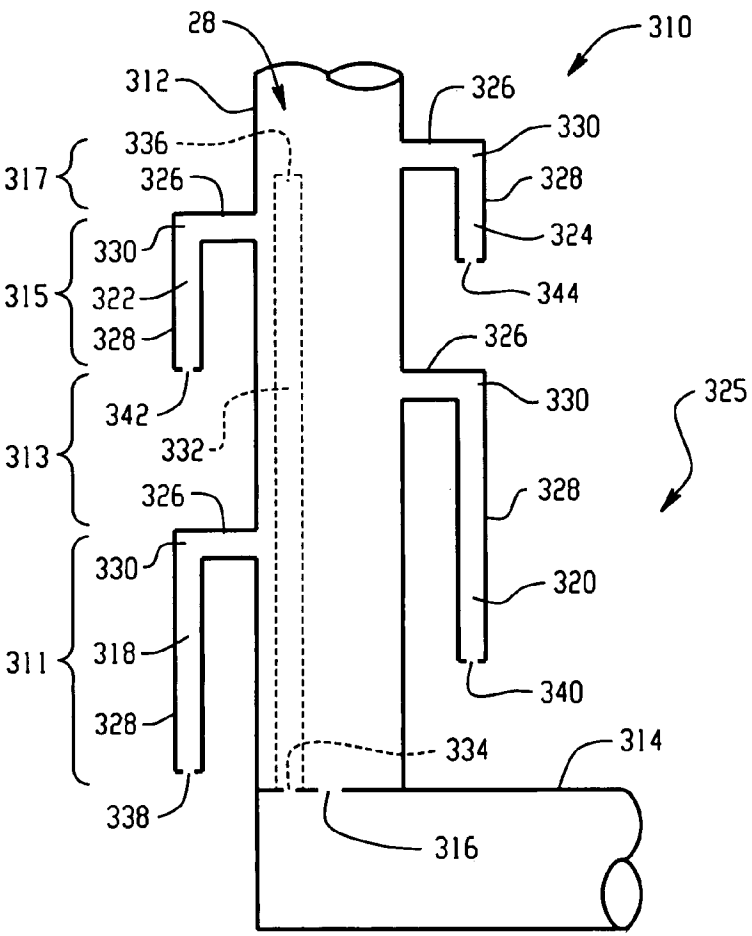
FIG. 20 is a diagrammatic, section view of another embodiment of a stormwater detention system.

Referring to FIG. 20, another illustrated detention system 310 utilizes a co-axial surge chamber configuration that includes a surge conduit 312 having multiple surge chamber sections 311, 313, 315, 317 and a discharge conduit 314 connected thereto. The discharge conduit 314 directs stormwater from the surge conduit 312 to a receptacle, such as a water lounge or storm sewer (not shown). A primary discharge outlet 316 having an opening of fixed dimension provides communication between the surge conduit 312 and the discharge conduit 314. Allowing for stormwater overflow discharge from the surge conduit 312 to an outside receptacle 325, such as a detention pond or storage chamber, are outlet passageways 318, 320, 322 and 324 located at increasing elevations along the height of the surge conduit. The outlet passageways 318, 320, 322, 324 each include a relatively horizontal portion 326 and a relatively vertical portion 328 connected by a bend 330. The outlet passageways may be set at elevations that correspond to respective rated storm events. The vertical portions 328 extend to differing elevations with an outlet 338, 340, 342, 344 having an opening of fixed dimension located at a respective free end of the vertical portions, which can provide controlled stormwater flow from the surge conduit 312 to the outside receptacle as the stormwater level rises about the surge conduit 312. In an alternative embodiment, a discharge passageway 332 (shown by dotted lines) can provide a secondary discharge path for the stormwater to discharge into the discharge conduit 314 via outlet 334. The discharge passageway 332 includes a fluid inlet 336 at an end opposite the outlet.

Figure 21:
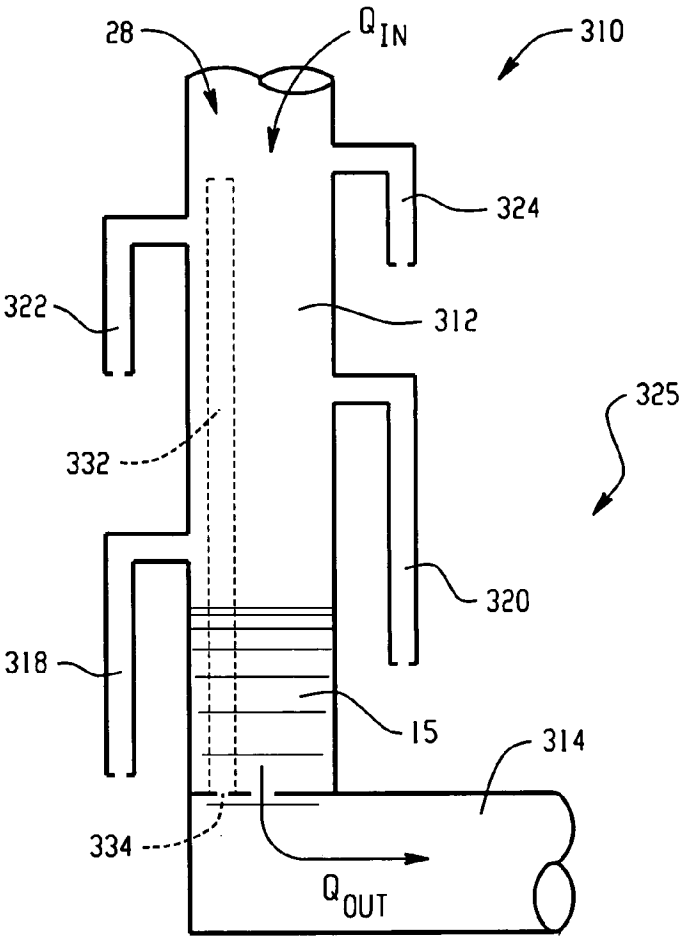
FIGS. 21–23 are section illustrations of the stormwater detention system of FIG. 20 in use.

Referring now to FIG. 21, as stormwater flows from the primary inlet 28 into the surge conduit 312 at a flow rate $Q_{in}$, stormwater is discharged from the surge conduit 312 through the discharge outlet 316 at a flow rate $Q_{out}$ bypassing the receptacle 325. At relatively low stormwater inflow levels, most, if not all, of the stormwater received in surge conduit 312 is discharged directly through the outlet 316, bypassing the receptacle 325. As shown, at higher inflow levels, the outlet 316 is sized such that the surge conduit 312 fills with stormwater 15, increasing both the hydraulic head and the discharge rate $Q_1$ through the outlet 316.

Figure 23:
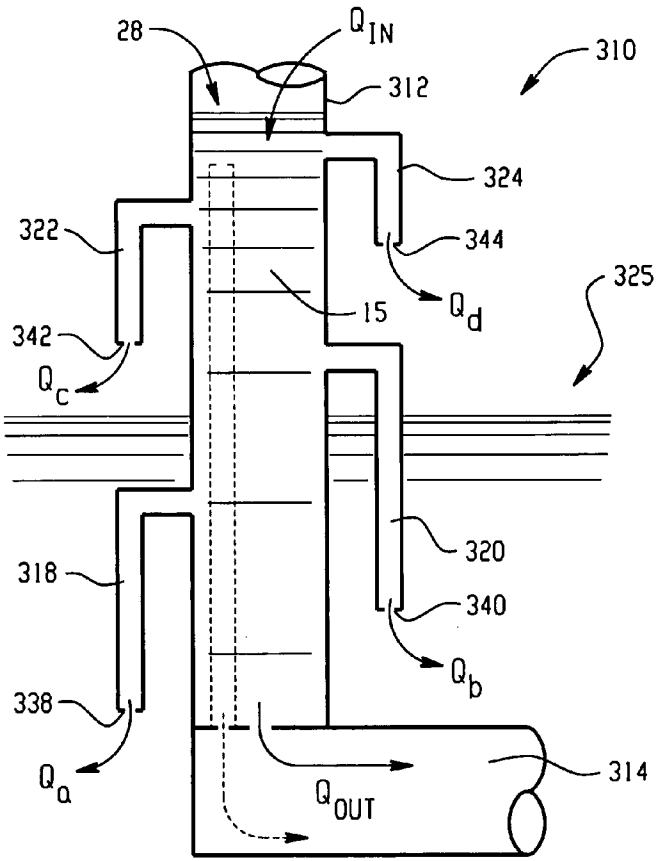
Figure 22:
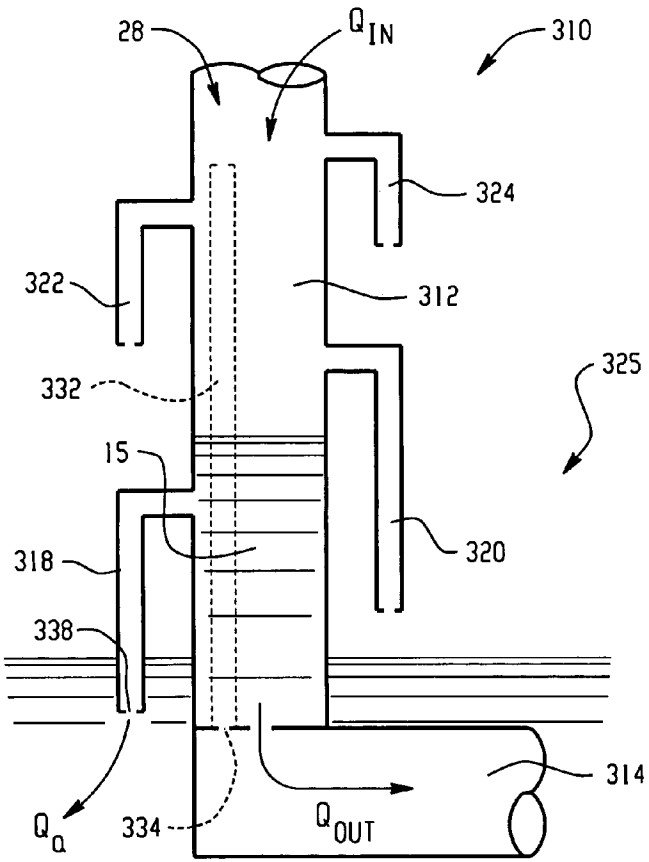

Referring to FIG. 22, certain intense storms result in stormwater flow from the surge conduit 312 through passageway 318 to the receptacle 325 at a flow rate $Q_a$ while stormwater continues to discharge at flow rate $Q_{out}$ from surge conduit 312. As the stormwater level rises in the receptacle 325 above the elevation of outlet 338, the hydraulic head generated by the stormwater level in the receptacle decreases $Q_a$ from the surge conduit 312 causing the total discharge rate from the surge chamber ($Q_a$ plus $Q_{out}$) to decrease. If the total discharge rate from the surge conduit 312 is less than $Q_{in}$ the stormwater level increases in the surge conduit, automatically increasing $Q_{out}$. Referring to FIG. 23, the above process can continue to repeat until the surge conduit is filled, automatically increasing $Q_{out}$, with stormwater discharging from each of the passageways at respective flow rates $Q_a$, $Q_b$, $Q_c$, and $Q_d$.

The detention systems described above utilize primarily (or exclusively) non-mechanical components, such as weirs, specifically sized diameter orifices, siphons, conduits, etc., in directing stormwater flow within the detention system and in metering flow of stormwater to the external environment, for example, in compliance with controlling laws, ordinances, etc. setting maximum flow rates for a given storm intensity. Such use of non-mechanical components can improve the reliability of and decrease maintenance costs for the detention system. In some cases, the detention systems automatically adjust stormwater discharge from the detention system to the receiving environment depending, at least in part, on stormwater detention level in the detention system, which may depend on a particular storm's intensity. Such automatic adjustment of stormwater discharge from the detention system can optimize stormwater outflow from the detention system for storms of varying intensities, which can result in a significant reduction in the required storage volume and/or the footprint size of detention systems designed to accommodate runoff from high-intensity storms. The discharge systems may be suitable for use as a buried system or for use with a surface system, such as a detention pond.

In some embodiments, at the beginning of a storm, all of the stormwater flow may be controllably discharged through the first surge tank until the storm exceeds an allowable discharge rate for a design storm of a first return period. During this initial period, a "first flush" of grit from, e.g., parking lots, etc. may be discharged from the detention system at rates exceeding those of certain conventional designs. In some embodiments, discharge velocities during this initial period may be greater than that necessary to scour grit through the detention system.

In some embodiments, relatively small buried or above-ground detention systems may be used to provide a similar magnitude of storage volume savings when used with conventional detention ponds, for example, in lieu of buried detention systems. For example, use of separate storage chambers for each design storm of specified return period may be adapted directly to a series of separate detention ponds. A system that senses the stormwater volume stored in the detention ponds can be packaged into an enclosure and placed in or beside a single detention pond. In some cases, enclosures used to contain surge chambers and/or storage chambers can be used for additional storage (e.g., underground).

A number of detailed embodiments have been described. Nevertheless, it will be understood that various modifications may be made. For example, while a certain number of surge and storage chambers are depicted in each of the above-described embodiments, it should be understood that the number of surge and/or storage chambers can be increased and/or decreased depending on, e.g., the desired end use and control requirements. Also, as noted above, the discharge outlets from the surge chambers for discharging stormwater from the detention systems can be sized to provide pre-selected discharge rates with the stormwater at its peak within the surge chambers. For example, due to local laws governing stormwater runoff, it may be desirable to limit discharge from the detention system to the receiving environment to no more than a pre-selected flow rate for a particular storm event (e.g., a two-year storm event, a ten-year storm event, a 25-year storm event, a 100-year storm event, etc.). As an alternative to use of outlets having openings of fixed dimension, in some cases, variable dimension outlets may be utilized. Further controls may also be included. Additionally, combinations of the above embodiments including any variations can be provided such as by connecting any two or more of the above-described embodiments to allow stormwater flow therebetween.

In some cases, the above detention systems may be used with an additional storage volume, such as a connected storage tank, detention pond, underground storage, etc., that is sized to detain an initial amount of rainfall (e.g., the initial one-half inch of rain). This additional storage volume may include an oils skimmer and volume for silt and granules to settle. After this initial amount of stormwater is detained, the detention system may begin to fill. In some cases, the additional amount of storage volume holds the initial amount of rainfall until after the storm event subsides and other storage units drain down. Alternatively, this initial amount of rainfall can be routed to a wet pond, recharge chamber, etc., for example, to avoid discharge of pollutants to a watercourse. Accordingly, other embodiments are within the scope of the following claims.

What is claimed is:

1. A stormwater runoff detention system, comprising:

a tank system at least in part defining:

a first surge volume, a second surge volume and at least one storage volume that is substantially greater than each of the first surge volume and the second surge volume, the first surge volume is in fluid communication with a discharge outlet of the tank system to permit stormwater to exit the tank system at a rate not to exceed a first permitted flow rate, the first surge volume is in fluid communication with the at least one storage volume to permit stormwater to enter the at least one storage volume when inflow rate to the first surge volume exceeds the first permitted flow rate;

the second surge volume is in fluid communication with the discharge outlet of the tank system to permit stormwater to exit the tank system, wherein stormwater exiting the tank system from the first surge volume and the second surge volume does so at a rate not to exceed a second permitted flow rate that is greater than the first permitted flow rate, the second surge volume is in fluid communication with the at least one storage volume to permit additional stormwater to enter the at least one storage volume when combined inflow rate to the first surge volume and the second surge volume exceeds the second permitted flow rate.

2. The stormwater runoff detention system of claim 1 wherein the first surge volume is defined by a first surge chamber and the second surge volume is defined by a second surge chamber.

3. The stormwater runoff detention system of claim 2 wherein the first surge chamber is in direct fluid communication with the second surge chamber.

4. The stormwater runoff detention system of claim 2 wherein the first surge chamber is in fluid communication with the second surge chamber via the at least one storage volume.

5. The stormwater runoff detention system of claim 2 wherein the first surge chamber is in fluid communication with the second surge chamber via a flow path separate from the at least one storage volume.

6. The stormwater runoff detention system of claim 1 wherein the first surge volume is in fluid communication with the discharge outlet via a first surge outlet that flows to the discharge outlet without entering the second surge volume.

7. The stormwater runoff detention system of claim 1 wherein the first surge volume is in fluid communication with the discharge outlet via a first surge outlet that flows to the second surge volume, and the second surge volume includes a second surge outlet in fluid communication with the discharge outlet.

8. The stormwater runoff detention system of claim 1 wherein the first surge volume and second surge volume are defined by distinct parts of a single surge chamber.

9. The stormwater runoff detention system of claim 1 wherein the at least one storage volume comprises a single storage chamber.

10. The stormwater runoff detention system of claim 1 wherein the at least one storage volume comprises multiple storage chambers.

11. The stormwater runoff detention system of claim 1 wherein the at least one storage volume is comprised in part by at least one detention pond that is in fluid communication with the tank system.

12. The stormwater runoff detention system of claim 1 wherein the at least one storage volume includes a storage outlet in fluid communication with the discharge outlet, the storage outlet including valve means for preventing flow from the at least one storage volume to the discharge outlet under certain circumstances.

13. The stormwater runoff detention system of claim 1 wherein the first surge volume is formed by a first surge chamber, the second surge volume is formed by a second surge chamber, and the at least one storage volume comprises a first storage chamber and a second storage chamber;

the first surge chamber receives stormwater from an inlet of the tank system and includes an outlet to the first storage chamber, the first surge chamber includes a surge discharge outlet;

the first storage chamber includes an outlet to the second surge chamber, and the second surge chamber includes an outlet to the second storage chamber and a surge discharge outlet.

14. The stormwater runoff detention system of claim 13 wherein a volume of the first storage chamber corresponds to a first storm event of specified return period and a discharge rate through the surge discharge outlet of the first surge chamber during overflow to the first storage chamber is at the first permitted flow rate, which corresponds to a legally permitted discharge rate for the first storm event.

15. The stormwater runoff detention system of claim 14 wherein a combined volume of the first storage chamber and the second storage chamber corresponds to a second storm event having a less frequent return period than the first storm event, and a combined discharge rate through the surge discharge outlet of the first surge chamber and through the surge discharge outlet of the second surge chamber during overflow to the second storage chamber is at the second permitted flow rate, which corresponds to a legally permitted discharge rate for the second storm event.

16. The stormwater runoff detention system of claim 1 further comprising a one-way valve allowing for fluid discharge from at least one of the first and/or second storage chambers.

17. The stormwater runoff system of claim 1 wherein the first surge volume is formed by a first surge chamber, the second surge volume is formed by a second surge chamber and the storage volume comprises a storage chamber;

the first surge chamber connected to receive stormwater from an inlet of the tank system prior to the second surge chamber or the storage chamber, the first surge chamber including a surge discharge outlet and an overflow outlet to the storage chamber; and the second surge chamber connected to receive stormwater from the inlet primarily after the first surge chamber has begun overflowing to the storage chamber, the second surge chamber includes a surge discharge outlet and an overflow outlet to the storage chamber.

18. The stormwater runoff detention system of claim 17 wherein a discharge rate through the surge discharge outlet of the first surge chamber during overflow to the storage chamber is at the first permitted flow rate, which corresponds to a legally permitted discharge rate for a first storm event of specified return period, and wherein a combined discharge rate through the surge discharge outlet of the first surge chamber and through the surge discharge outlet of the second surge chamber during overflow from the second surge chamber to the storage chamber is at the second permitted flow rate, which corresponds to a legally permitted discharge rate for a second storm event having a less frequent return period than the first storm event.

19. The stormwater runoff detention system of claim 1 wherein the first surge volume is formed by a first surge chamber, the second surge volume is formed by a second surge chamber, the at least one storage volume comprises a first storage chamber and a second storage chamber, and the tank system further includes a head chamber;

the first surge chamber connected to receive stormwater from an inlet of the tank system and having an overflow outlet to the head chamber, the overflow outlet at a first elevation, the first surge chamber including a surge discharge outlet;

the second surge chamber having an inlet to receive stormwater from the head chamber, the inlet located at a second elevation different from the first elevation, the second surge chamber including a surge discharge outlet;

the first storage chamber in flow communication with the head chamber at a third elevation different from the first and second elevations;

the second storage chamber having an inlet to receive stormwater from the head chamber, the inlet of the second storage chamber located at a fourth elevation between the first and second elevations.

20. The stormwater runoff detention system of claim 19, wherein the second elevation is lower than the first elevation, the third elevation is below the second elevation and the fourth elevation is above the second elevation and below the first elevation.

21. The stormwater runoff detention system of claim 19, wherein the first storage chamber includes a first outlet providing communication between the first storage chamber and the head chamber; and the second storage chamber includes a second outlet providing communication between the second storage chamber and the head chamber;

wherein the first and second outlets allow communication from their respective storage chambers to the head chamber in response to respective predetermined pressure differentials.

22. The stormwater runoff detention system of claim 1 wherein:

the tank system includes an inlet, a surge chamber and a storage chamber, the first surge volume and the second surge volume are formed by respective parts of the surge chamber;

the surge chamber includes a surge discharge outlet, a first outlet to the storage chamber and a second outlet to the storage chamber, the first outlet at a first elevation and the second outlet at a second elevation that is higher than the first elevation, the first elevation corresponds to a first surge chamber head that defines the first surge volume and sets a discharge rate from the surge chamber through the surge discharge outlet to the first permitted flow rate, which is a first legally permitted rate for a first storm event of specified return period, the second elevation corresponds to a second surge chamber head that sets the discharge rate from the surge chamber through the surge discharge outlet to the second permitted flow rate, which is a second legally permitted rate for a second storm event having a less frequent return period than the first storm event, the second surge volume is defined by the surge chamber volume between the first surge chamber head and the second surge chamber head.

23. A stormwater runoff detention system, comprising:

a tank system including an inlet, the tank system at least in part defining first and second surge chambers and at least one storage chamber, a first flow passage provided between the first surge chamber and the storage chamber, a second flow passage provided between the second surge chamber and the storage chamber;

when water flows into the inlet of the tank system at a first flow rate, the first surge chamber fills to a certain level to reach the first flow passage, at which point water flows from the first surge chamber to the storage chamber along the first flow passage;

when water flows into the inlet of the tank system at a second flow rate that is higher than the first flow rate, the first surge chamber fills to a certain level to reach the first flow passage, at which point water flows from the first surge chamber to the storage chamber along the first flow passage, and subsequent to filling the first surge chamber and water flow into the storage chamber, the second surge chamber fills to a specific level to reach the second flow passage, at which point water flows from the second surge chamber along the second flow passage to the storage chamber.

24. The stormwater runoff detention system of claim 23, wherein at least one of the first and/or second flow passages includes an outlet having an opening of fixed dimension, the outlet capable of communicating with the storage chamber.

25. The stormwater runoff detention system of claim 23, wherein the first and second flow passages include respective outlets having respective openings of respective fixed dimensions, the outlets of the first and second flow passages capable of communicating with the storage chamber.

26. The stormwater runoff detention system of claim 23, wherein at least one of the first and/or second flow passages are formed by a spout having a relatively vertical portion and a bend, the vertical portion terminating at an outlet having an opening of fixed dimension located in the storage chamber.

27. The stormwater runoff detention system of claim 23, wherein the first and second flow passages include a relatively horizontal portion connected to a relatively vertical portion by a bend, the vertical portion of the first flow passage terminating at a first outlet having an opening of fixed dimension located in the storage chamber and the second flow passage terminating at a second outlet having an opening of fixed dimension located in the storage chamber.

28. The stormwater runoff detention system of claim 27, wherein the second outlet is located at a higher elevation in the storage chamber than the first outlet.

29. The stormwater runoff detention system of claim 23, wherein at least one of the first and/or second flow passages is defined by a siphon.

30. The stormwater runoff detention system of claim 29, wherein the siphon includes a first leg disposed in the storage chamber and a second leg disposed in the respective surge chamber.

31. The stormwater runoff detention system of claim 30, wherein the first leg is shorter than the second leg.

32. The stormwater runoff detention system of claim 23, wherein the first flow passage is defined by a first siphon and the second flow passage is defined by a second siphon.

33. The stormwater runoff detention system of claim 32, wherein the first and second siphons each include a leg including an outlet of fixed dimension located in the storage chamber, the outlet of the second siphon being located at a higher elevation than the outlet of the first siphon.

34. The stormwater runoff detention system of claim 23, wherein the first flow passage is defined by a first opening providing communication between the first surge chamber and the storage chamber.

35. The stormwater runoff detention system of claim 34, wherein the second flow passage is defined by a second opening providing communication between the second surge chamber and the storage chamber.

36. The stormwater runoff detention system of claim 23 further comprising a valve providing one-way communication between the storage chamber and one or more of the first and second surge chambers.

37. The stormwater runoff detention system of claim 23, wherein the tank system at least in part defining a third surge chamber and a third flow passage provided between the third surge chamber and the storage chamber such that when water flows into the inlet of the tank system at a third flow rate that is higher than the second flow rate, the first surge chamber fills to a certain level to reach the first flow passage, at which point water flows from the first surge chamber to the storage chamber along the first flow passage, and subsequent to filling the first surge chamber and water flow into the storage chamber along the first flow passage, the second surge chamber fills to a specific level to reach the second flow passage, at which point water flows from the second surge chamber along the second flow passage to the storage chamber, and subsequent to filling the second surge chamber and water flow into the storage chamber along the second flow passage, the third surge chamber fills to a specific level to reach the third flow passage, at which point water flows from the third surge chamber along the third flow passage to the storage chamber.

38. A stormwater detention system comprising multiple stormwater detaining portions connected together including a storage portion, a first surge portion and a second surge portion the first surge portion and second surge portion each having a respective detention volume less than that of the storage portion, the first and second surge portions being in communication with a discharge outlet configured to allow discharge of stormwater from the first and second surge portions along a path bypassing the storage portion, wherein stormwater flow into the detention system enters the first surge portion, when the first surge portion fills to a predetermined level incoming stormwater flows into at least one of the storage potion and/or the second surge portion.

39. The stormwater detention system of claim 38, wherein the discharge outlet has an opening of fixed dimension.

40. The stormwater detention system of claim 38 further comprising an inlet connected to the first surge portion.

41. The stormwater detention system of claim 40, wherein the first and second surge portions are defined at least in part by a surge conduit and the path bypassing the storage portion is defined at least in part by a discharge conduit connected to the surge conduit.

42. The stormwater detention system of claim 41 further comprising a third conduit defining a fluid passageway extending through the first and second surge portions defined by the surge conduit, the third conduit having an outlet disposed at a first end of the third conduit and an inlet disposed at a second end opposite the first end, the outlet capable of communicating with the discharge conduit.

43. The stormwater detention system of claim 41, wherein at least one of the first and/or second surge portions is connected to a flow passage extending between the at least one of the first and second surge portions to the storage portion.

44. The stormwater detention system of claim 43, wherein the flow passage includes a relatively horizontal portion connected to a relatively vertical portion by a bend.

45. The stormwater detention system of claim 40, wherein the first surge portion comprises a first surge chamber and the second surge portion comprises a second surge chamber.

46. The stormwater detention system of claim 45 further comprising a first flow passage provided between the first surge chamber and the storage portion, a second flow passage provided between the second surge chamber and the storage portion;

when water flows into the inlet at a first flow rate, the first surge chamber fills to a certain level to reach the first flow passage, at which point water flows from the first surge chamber to the storage portion along the first flow passage;

when water flows into the inlet at a second flow rate that is higher than the first flow rate, the first surge chamber fills to a certain level to reach the first flow passage, at which point water flows from the first surge chamber to the storage portion along the first flow passage, and subsequent to filling the first surge chamber and water flow into the storage portion, the second surge chamber fills to a specific level to reach the second flow passage, at which point water flows from the second surge chamber along the second flow passage to the storage chamber.

47. The stormwater detention system of claim 38, wherein the storage portion comprises a pond.

48. A method of stormwater detention, the method comprising:

filling a first surge chamber to a level that establishes a first discharge rate through a discharge outlet of the first surge chamber;

overflowing any additional inflowing stormwater from the first surge chamber to a first storage volume;

directing any additional inflowing stormwater in excess of the first storage volume into a second surge chamber to fill said second surge chamber to a level that establishes a second discharge rate through a discharge outlet of the second surge chamber;

overflowing any additional inflowing stormwater from the second surge chamber to a second storage volume;

wherein the first storage volume corresponds to a first storm event of specified return period and the first discharge rate corresponds to a legally permitted discharge rate for the first storm event;

wherein the second storage volume corresponds to a second storm event of less frequent return period than the first storm event, and the combination of the first discharge rate and the second discharge rate corresponds to a legally permitted discharge rate for the second storm event.

49. The method of claim 48, wherein the first storage volume and the second storage volume are defined by separate chambers.

50. The method of claim 48, wherein the first storage volume and the second storage volume are defined by different portions of one or more common chambers.

* * * * *

UNITED STATES PATENT AND TRADEMARK OFFICE

CERTIFICATE OF CORRECTION

PATENT NO. : 7,186,058 B2
APPLICATION NO. : 11/036772
DATED : March 6, 2007
INVENTOR(S) : James C. Schluter et al.

It is certified that error appears in the above-identified patent and that said Letters Patent is hereby corrected as shown below:

Column 18

Line 37 Change "potion" to -- portion --.

Signed and Sealed this

Twenty-sixth Day of February, 2008

JON W. DUDAS
*Director of the United States Patent and Trademark Office*